US011046406B1

(12) United States Patent
Kunanec et al.

(10) Patent No.: US 11,046,406 B1
(45) Date of Patent: Jun. 29, 2021

(54) WATERCRAFT AND VENTURI UNIT

(71) Applicant: BOMBARDIER RECREATIONAL PRODUCTS INC., Valcourt (CA)

(72) Inventors: Robert Kunanec, Bromont (CA); Frederick Lasnier, Ste-Cecile-de-Milton (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 16/777,070

(22) Filed: Jan. 30, 2020

Related U.S. Application Data

(60) Provisional application No. 62/798,790, filed on Jan. 30, 2019.

(51) Int. Cl.

| | |
|---|---|
| ***B63H 11/11*** | (2006.01) |
| ***B63H 11/00*** | (2006.01) |
| ***B63H 11/113*** | (2006.01) |
| *B63B 34/10* | (2020.01) |

(52) U.S. Cl.
CPC ..... *B63H 11/11* (2013.01); *B63H 11/00* (2013.01); *B63H 11/113* (2013.01); *B63B 34/10* (2020.02)

(58) Field of Classification Search
CPC ..... B63H 11/00; B63H 11/10; B63H 11/103; B63H 11/11; B63H 11/113; B63B 13/00; F04F 5/00; F04F 5/10; F04F 5/46; F04F 1/00; F04F 1/06; F04F 1/18
USPC ..... 440/41, 47
See application file for complete search history.

(56) References Cited

U.S. PATENT DOCUMENTS

| | | | | |
|---|---|---|---|---|
| 3,273,333 A * | 9/1966 | Roulund | B63H 11/12 440/44 |
| 3,338,169 A | 8/1967 | Kinney | |
| 4,027,617 A | 6/1977 | Ikeda et al. | |
| 4,373,919 A | 2/1983 | Stangeland | |
| 4,850,980 A * | 7/1989 | Lentz | A61M 5/14216 604/248 |
| 5,123,867 A | 6/1992 | Broinowski | |
| 5,151,057 A | 9/1992 | Kobayashi et al. | |
| 5,176,547 A | 1/1993 | Kobayashi et al. | |
| 5,176,548 A | 1/1993 | Morgan | |

(Continued)

OTHER PUBLICATIONS greenhulk.net, Seadoo siphoning system, vBulletin Solutions, Inc., retieved from http://greenhulk.net/forums/showthread.php?t=260569 on Jan. 28, 2020.

*Primary Examiner* — Lars A Olson
(74) *Attorney, Agent, or Firm* — BCF LLP

(57) ABSTRACT

A watercraft includes a jet propulsion system having a venturi unit and an impeller. The impeller is rotatable in a forward direction for propelling water rearward out of the venturi unit, and a reverse direction for propelling water forward through the venturi unit. A bailer-siphon system of the watercraft includes a fluid conduit defined in part by a valve, the fluid conduit having a fluid inlet in the motor compartment and a fluid outlet at the venturi unit. The valve is operable between an open position in which the valve fluidly connects the fluid inlet to the fluid outlet, and a closed position in which the valve fluidly disconnects the fluid inlet from the fluid outlet. The valve is in the open position when the impeller rotates in the forward direction. The valve is in the closed position when the impeller rotates in the reverse direction.

22 Claims, 31 Drawing Sheets

(56) References Cited

U.S. PATENT DOCUMENTS

| | | | |
|---|---|---|---|
| 5,184,966 | A | 2/1993 | Kobayashi et al. |
| 5,224,887 | A | 7/1993 | Futaki |
| 5,254,023 | A | 10/1993 | Kobayashi |
| 5,254,024 | A | 10/1993 | Kobayashi et al. |
| 5,468,165 | A | 11/1995 | Weber et al. |
| 5,490,504 | A | 2/1996 | Vrona et al. |
| 5,509,832 | A | 4/1996 | Roos |
| 5,522,742 | A | 6/1996 | Futaki et al. |
| 5,577,941 | A | 11/1996 | Chartier |
| 5,598,804 | A | 2/1997 | Vostitsanos |
| 5,690,520 | A | 11/1997 | Rheault |
| 5,779,508 | A | 7/1998 | Pettesch et al. |
| 5,846,105 | A | 12/1998 | Baker et al. |
| 5,863,229 | A | 1/1999 | Matte |
| 5,876,258 | A | 3/1999 | Gray |
| 5,934,953 | A | 8/1999 | Kobayashi |
| 5,951,130 | A | 9/1999 | Braunschweig et al. |
| 5,989,083 | A | 11/1999 | Ishigaki et al. |
| 6,033,272 | A | 3/2000 | Whiteside |
| 6,083,063 | A | 7/2000 | Neisen |
| 6,183,319 | B1 | 2/2001 | Ishigaki |
| 6,253,696 | B1 * | 7/2001 | Mashiko ..... F01N 13/004 114/55.5 |
| 6,267,632 | B1 | 7/2001 | Blanchard |
| 6,283,805 | B1 | 9/2001 | Ishigaki |
| 6,293,836 | B1 | 9/2001 | Blanchard |
| 6,482,055 | B1 | 11/2002 | Freitag |
| 6,645,018 | B2 | 11/2003 | Ishigaki |
| 6,821,167 | B2 | 11/2004 | Ishigaki et al. |
| 6,857,920 | B2 | 2/2005 | Marathe et al. |
| 6,899,575 | B1 | 5/2005 | Rothe et al. |
| 7,377,826 | B1 | 5/2008 | Wengren, Jr. |
| 7,950,974 | B2 | 5/2011 | Rui |
| 8,007,329 | B2 | 8/2011 | Wengren, Jr. |
| 9,346,522 | B2 | 5/2016 | Ruosteinen et al. |
| 9,376,189 | B1 | 6/2016 | De Henau et al. |
| 2012/0011828 | A1 | 1/2012 | Nicholson |
| 2012/0178318 | A1 | 7/2012 | Rasidescu et al. |

* cited by examiner

WATERCRAFT AND VENTURI UNIT

CROSS-REFERENCE

The present application claims priority from U.S. Provisional Application No. 62/798,790, filed Jan. 30, 2019, the entirety of which is incorporated herein by reference.

FIELD OF TECHNOLOGY

The present invention relates to a jet propulsion system of a watercraft.

BACKGROUND

Water jet propelled watercraft, such as personal watercraft and jet boats, offer high performance, acceleration, handling, and allow for shallow-water operation.

A common problem with jet propulsion systems is that foreign objects such as vegetation (e.g. weeds), rocks, rope and other debris can get drawn into the jet propulsion system and remain lodged therein. For example, foreign objects can get caught on an intake grate, a driveshaft or an impeller of the jet propulsion system. Clogs caused by these foreign objects can in turn adversely affect performance of the system, notably by reducing a thrust generated by the jet propulsion system. In turn, the reduced thrust in combination with high speed rotation of the impeller can form low pressure areas around the blades of the impeller and thus cause cavitation thereof. In addition, the clogs can in some cases block cooling water flow and thus lead to overheating. While the jet propulsion system can be unclogged manually by accessing a bottom of the watercraft's hull, this can be a difficult and time-consuming task for the operator.

To address this issue, it has been proposed to operate a jet propulsion system in reverse so as to propel water towards an inlet thereof (as opposed to a rearward outlet at a steering nozzle of the jet propulsion system) and use the generated thrust to clear clogs in the jet propulsion system. However, many water jet propelled watercraft are equipped with a bailer-siphon system that uses the fluid flow through the jet propulsion system to suction water out of the watercraft's engine compartment, which water may from time to time enter when in use. In at least some cases, such bailer-siphon systems, while being suitable for their intended purposes, are suboptimal for a jet propulsion system operating in reverse.

More particularly, when a jet propulsion system is operated in reverse and there is no water proximate the bailer-siphon system's inlet, water flows in reverse through the venturi unit thereof and may entrain air from the bailer-syphon system into the flow of water through the venturi unit. This may aerate the impeller of the jet propulsion system. In at least some cases, aeration of the impeller reduces its efficiency and reduces debris clearing performance of the jet propulsion system.

In view of the foregoing, there is a need for a watercraft with a jet propulsion system that reduces or eliminates aeration of the impeller during reverse operation of the impeller.

SUMMARY OF THE INVENTION

It is an object of the present invention to ameliorate at least some of the inconveniences present in the prior art.

For the purposes of this document, the term "conduit" refers to a notional fluid connection and is defined by at least one physical line and/or other components that define at least one fluid conduit (such as a peripheral wall of a venturi unit, a fluid inlet, a fluid outlet, a siphon break, a valve, and the like). For example, in some embodiments, a fluid "conduit" that connects points A and B is defined by a single (physical) fluid line, such as a hose, connecting the points A and B. As another example, in some embodiments, the fluid "conduit" is defined by two or more (physical) fluid lines interconnected in series or parallel with a common inlet and/or outlet, in some cases via elements such as a siphon break and a valve, and connecting the points A and B.

In turn, for the purposes of this document, the term "line" refers to a physical line for conveying a fluid, such as water and/or air. One example of a fluid line is a rubber hose. Another example of a fluid line is a plastic tube.

According to one aspect of the present technology, there is provided a watercraft having: a hull having a bow and a stern opposite the bow, the hull defining at least a part of a motor compartment; a motor supported by the hull and disposed within the motor compartment; and a jet propulsion system. The jet propulston system has: a duct defining a water inlet in a bottom of the hull; a venturi unit defining part of the duct and defining a venturi outlet; an impeller housing defining part of the duct and disposed between the inlet and the venturi unit; and an impeller disposed within the impeller housing, the impeller being operatively connected to the motor, the impeller being rotatable about an impeller rotation axis in (i) a forward direction whereby the impeller propels water from the water inlet rearward and out of the venturi outlet, and (ii) a reverse direction whereby the impeller propels water from the venturi outlet forward and out of the water inlet. The watercraft also has a bailer-siphon system having a fluid conduit, the fluid conduit being defined in part by a valve. The fluid conduit has: a fluid inlet disposed inside the motor compartment for drawing water out of the motor compartment; and a fluid outlet in fluid communication with the venturi outlet at least when the impeller rotates in the forward direction while the watercraft is in use. The valve is operable between an open position in which the valve fluidly connects the fluid inlet to the fluid outlet, and a closed position in which the valve fluidly disconnects the fluid inlet from the fluid outlet. The valve is in the open position when the impeller rotates in the forward direction while the watercraft is in use thereby allowing flow of water through the venturi outlet to move water out of the motor compartment, the water entering the fluid inlet of the fluid conduit and exiting the fluid outlet of the fluid conduit. The valve is in the closed position when the impeller rotates in the reverse direction while the watercraft is in use.

In some embodiments, the valve is moved to the open position when the impeller rotates in the forward direction while the watercraft is in use. The valve is moved to the closed position when the impeller rotates in the reverse direction while the watercraft is in use.

In some embodiments, the valve is disposed at the venturi unit.

In some embodiments, the valve is operated between the open position and the closed position by a direction of flow of water through the duct.

In some embodiments, the valve includes an element pivotable about a pivot axis by flow of water generated by the impeller to operate the valve between the open position and the closed position.

In some embodiments, the element extends at least in part into the venturi unit such that the element is exposed to flow of water through the venturi conduit.

In some embodiments, the element includes a ball portion pivotable about the pivot axis. The ball portion defines an aperture through the ball portion. The aperture defines part of the fluid conduit when the valve is in the open position. An outer surface of the ball portion blocks the fluid conduit when the valve is in the closed position.

In some embodiments, the element includes an arm connected to the ball portion to pivot the ball portion about the pivot axis, the arm extending at least in part into the venturi unit.

In some embodiments, the element defines the fluid outlet.

In some embodiments, the venturi unit includes a peripheral wall; and the element is disposed radially inward of the peripheral wall.

In some embodiments, the inner side of the peripheral wall defines a recess. A part of the element is received pivotally in the recess. The venturi unit includes a resilient element that pushes the part of the element into the recess.

In some embodiments, the arm is a tube having a free end, the tube being attached to the ball portion to pivot together with the ball portion about the pivot axis to thereby operate the valve between the open position and the closed position. The tube is in fluid communication with the aperture in the ball portion. The free end of the tube is the fluid outlet.

In some embodiments, the peripheral wall defines a part of the fluid conduit.

In some embodiments, the venturi unit includes a peripheral wall; and the arm is disposed at least in part radially inward of the peripheral wall.

In some embodiments, the ball portion is disposed at least in part radially outward of the peripheral wall.

In some embodiments, vthe valve is disposed between the fluid inlet and the fluid outlet.

In some embodiments, the venturi unit includes a peripheral wall; the fluid outlet is disposed radially outward of the peripheral wall; the valve fluidly connects the fluid outlet to the venturi outlet via a passage through the peripheral wall when the impeller rotates in the forward direction; and the valve fluidly disconnects the fluid outlet from the venturi outlet when the impeller rotates in the reverse direction.

In some embodiments, the valve includes a ball; the ball is pushed away from an inner side of the peripheral wall by flow of water through the duct generated by the impeller rotating in the forward direction to fluidly connect the fluid outlet to the venturi outlet via the inner side of the peripheral wall; and the ball is pulled toward the inner side of the peripheral wall by flow of water through the duct generated by the impeller rotating in the reverse direction to fluidly disconnect the fluid outlet from the venturi outlet at the inner side of the peripheral wall.

In some embodiments, the jet propulsion system also has at least one of: a steering nozzle pivotable about a steering axis and about a variable trim system (VTS) axis relative to the venturi; and a reverse gate movable between a stowed position and a fully lowered position. The valve is operatively connected to one of the at least one of the steering nozzle and the reverse gate such that: when the at least one of the steering nozzle and the reverse gate is the steering nozzle, the valve is moved between the open and closed positions by rotation of the steering nozzle about the VTS axis; and when the at least one of the steering nozzle and the reverse gate is the reverse gate, the valve is moved by movement of the reverse gate such that the valve is moved to the closed position when the reverse gate is moved to a predetermined position, the predetermined position being the fully lowered position or a position intermediate the stowed position and the fully lowered position.

In some embodiments, at least one of the steering nozzle and the reverse gate includes the steering nozzle and the valve is operatively connected to the steering nozzle.

In some embodiments, the steering nozzle is pivotable about the VTS axis between a plurality of trim-up positions and a plurality of trim-down positions. The valve is moved to the closed position when the steering nozzle is pivoted to a predetermined trim-down position of the plurality of trim-down positions. The valve is at least partially open at positions other than the predetermined trim-down position.

In some embodiments, a VTS support is pivotable about the VTS axis. The steering nozzle pivots with the VTS support about the VTS axis. The steering nozzle pivots about the steering axis relative to the VTS support. The valve is operatively connected to the VTS support.

In some embodiments, a link operatively connects the valve to the VTS support. The link is pivotally connected to the valve. The link is pivotally connected to the VTS support.

In some embodiments, the valve is a ball valve.

According to another aspect of the present technology, there is provided a venturi unit for a jet propulsion system of a watercraft. The venturi unit has: a venturi conduit having a peripheral wall that defines a venturi inlet and a venturi outlet, the venturi inlet having a greater cross-sectional area than the venturi outlet; and a valve operable between an open position and a closed position and defining a part of a fluid conduit. The fluid conduit has: a fluid inlet fluidly adapted for connection to a bailer-siphon system; and a fluid outlet in fluid communication with the venturi outlet. The valve is in the open position during flow of water through the venturi conduit from the venturi inlet to the venturi outlet. The valve being in the closed position during flow of water through the venturi conduit from the venturi outlet to the venturi inlet. In the open position, the valve fluidly connects the fluid inlet to the fluid outlet. In the closed position, the valve fluidly disconnects the fluid inlet from the fluid outlet.

In some embodiments, the valve is operated: to the open position by flow of water through the venturi conduit from the venturi inlet to the venturi outlet, and to the closed position by flow of water through the venturi conduit from the venturi outlet to the venturi inlet.

In some embodiments, the valve includes an element pivotable about a pivot axis by flow of water through the venturi conduit to operate the valve between the open position and the closed position, the element including a ball portion pivotable about the pivot axis, the ball portion defining an aperture through the ball portion, the aperture defining part of the fluid conduit when the valve is in the open position, an outer surface of the ball portion blocking the fluid conduit when the valve is in the closed position.

In some embodiments, the element includes a tube having a free end, the tube being attached to the ball portion to pivot together with the ball portion about the pivot axis to thereby operate the valve between the open position and the closed position, the tube being in fluid communication with the aperture in the ball portion, the free end of the tube being the fluid outlet.

According to another aspect of the present technology, there is provided a watercraft having: a hull having a bow and a stern opposite the bow, the hull defining at least a part of a motor compartment; a motor supported by the hull and disposed within the motor compartment; and a jet propulsion system. The jet propulsion system has: a duct defining a water inlet in a bottom of the hull; a venturi unit defining part of the duct and defining a venturi outlet; at least one of: a steering nozzle pivotable about a steering axis and about a variable trim system (VTS) axis relative to the venturi; and a reverse gate movable between a stowed position and a fully lowered position; an impeller housing defining part of the duct and disposed between the inlet and the venturi unit; and an impeller disposed within the impeller housing, the impeller being operatively connected to the motor. The watercraft also has a bailer-siphon system having a fluid conduit. The fluid conduit is defined in part by a valve. The fluid conduit has: a fluid inlet disposed inside the motor compartment for drawing water out of the motor compartment; and a fluid outlet in fluid communication with the venturi outlet. The valve is operable between an open position in which the valve fluidly connects the fluid inlet to the fluid outlet, and a closed position in which the valve fluidly disconnects the fluid inlet from the fluid outlet. The valve is operatively connected to one of the at least one of the steering nozzle and the reverse gate such that: when the at least one of the steering nozzle and the reverse gate is the steering nozzle, the valve is moved between the open and closed positions by rotation of the steering nozzle about the VTS axis; and when the at least one of the steering nozzle and the reverse gate is the reverse gate, the valve is moved by movement of the reverse gate such that the valve is moved to the closed position when the reverse gate is moved to a predetermined position. The predetermined position is the fully lowered position or a position intermediate the stowed position and the fully lowered position.

In some embodiments, the impeller is rotatable about an impeller rotation axis in (i) a forward direction whereby the impeller propels water from the water inlet rearward and out of the venturi outlet, and (ii) a reverse direction whereby the impeller propels water from the venturi outlet forward and out of the water inlet. The valve is in the open position when the impeller rotates in the forward direction while the watercraft is in use thereby allowing flow of water through the venturi outlet to move water out of the motor compartment, the water entering the fluid inlet of the fluid conduit and exiting the fluid outlet of the fluid conduit, and the valve being in the closed position when the impeller rotates in the reverse direction while the watercraft is in use.

In some embodiments, at least one of the steering nozzle and the reverse gate includes the steering nozzle and the valve is operatively connected to the steering nozzle.

In some embodiments, the steering nozzle is pivotable about the VTS axis between a plurality of trim-up positions and a plurality of trim-down positions. The valve is moved to the closed position when the steering nozzle is pivoted to a predetermined trim-down position of the plurality of trim-down positions. The valve is at least partially open at positions other than the predetermined trim-down position.

In some embodiments, a VTS support is pivotable about the VTS axis. The steering nozzle pivots with the VTS support about the VTS axis. The steering nozzle pivots about the steering axis relative to the VTS support. The valve is operatively connected to the VTS support.

In some embodiments, a link operatively connects the valve to the VTS support. The link is pivotally connected to the valve. The link is pivotally connected to the VTS support.

In some embodiments, the valve is a ball valve.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
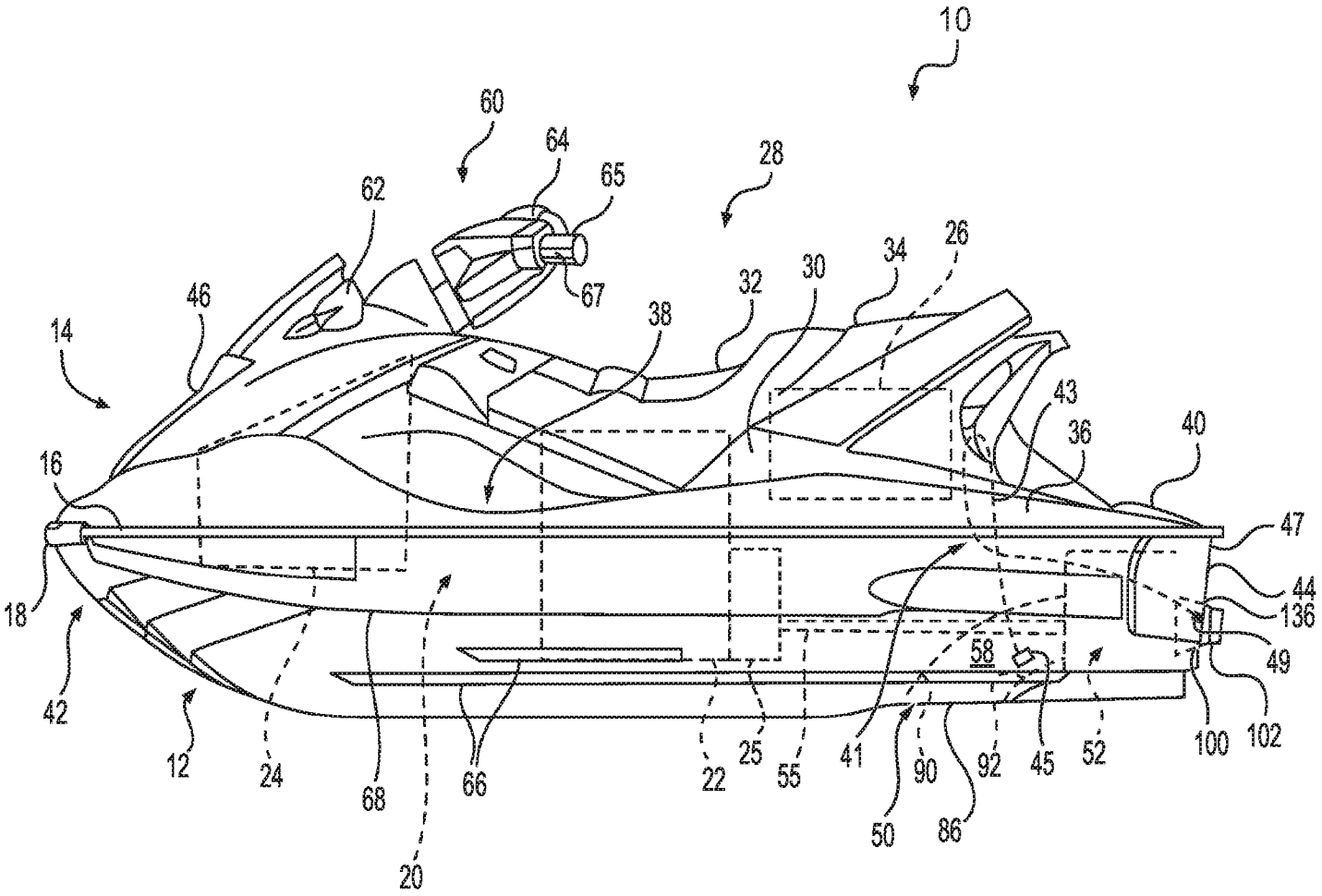
FIG. 1 is a left side elevation view of a personal watercraft in accordance with an embodiment of the present technology.
Figure 2:
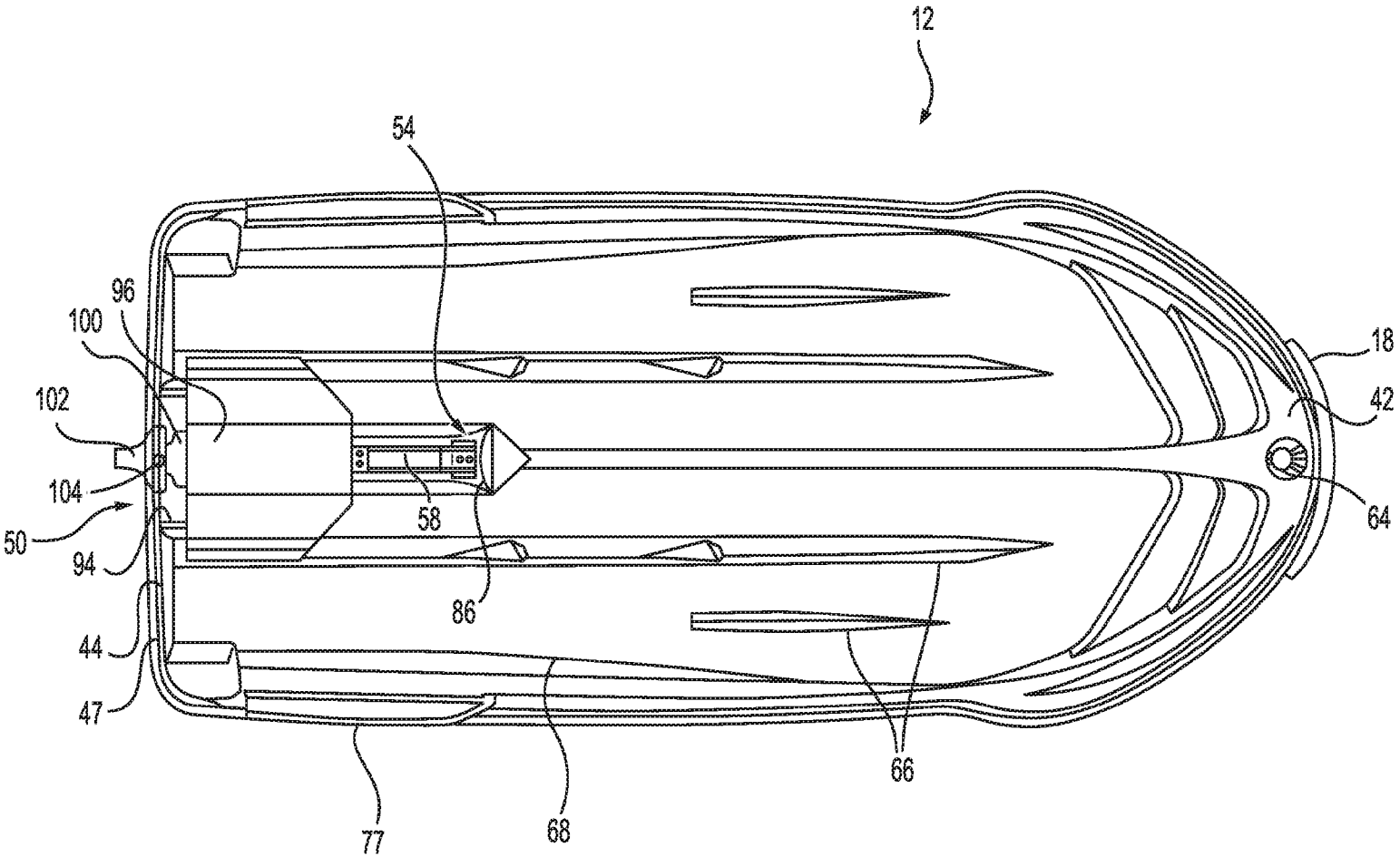
FIG. 2 is a bottom plan view of the watercraft of FIG. 1.

A personal watercraft 10 in accordance with one embodiment of the present technology is shown in FIGS. 1 and 2. The following description relates to one example of a personal watercraft. Those of ordinary skill in the art will recognize that there are other known types of personal watercraft incorporating different designs and that the present technology would encompass these other watercraft, as well as other water jet propelled watercraft such as jet boats and the like.

As will be discussed in greater detail below, the personal watercraft 10 has a jet propulsion system 50 for propelling the watercraft 10. In accordance with the present technology, the jet propulsion system 50 is configured to reverse a flow of water therein in such a manner as to clear the jet propulsion system 50 of foreign bodies.

The general construction of the personal watercraft 10 will now be described with respect to FIGS. 1 and 2.

The watercraft 10 has a hull 12 and a deck 14. The hull 12 has a bow 42 and a stern 44 opposite the bow 42. The hull 12 buoyantly supports the watercraft 10 in the water. The deck 14 is designed to accommodate one or multiple riders. The hull 12 and the deck 14 are joined together at a seam 16 that joins the parts in a sealing relationship. A bumper 18 generally covers the seam 16, which helps to prevent damage to the outer surface of the watercraft 10 when the watercraft 10 is docked, for example.

As seen in FIG. 1, the deck 14 has a centrally positioned straddle-type seat 28 positioned on top of a pedestal 30 to accommodate multiple riders in a straddling position. The seat 28 includes a front seat portion 32 and a rear, raised seat portion 34. The seat 28 is preferably made as a cushioned or padded unit, or as interfitting units. The front and rear seat portions 32, 34 are removably attached to the pedestal 30. The seat portions 32, 34 can be individually tilted or removed completely. Seat portion 32 covers a motor access opening defined by a top portion of the pedestal 30 to provide access to a motor 22. Seat portion 34 covers a removable storage bin 26 (FIG. 1). A small storage box is provided in front of the seat 28.

The watercraft 10 has a pair of generally upwardly extending walls located on either side of the watercraft 10 known as gunwales or gunnels 36. The gunnels 36 help to prevent the entry of water in the footrests 38 of the watercraft 10, provide lateral support for the riders' feet, and also provide buoyancy when turning the watercraft 10, since the personal watercraft 10 rolls slightly when turning.

Located on both sides of the watercraft 10, between the pedestal 30 and the gunnels 36, are the footrests 38. The footrests 38 are designed to accommodate the riders' feet in various riding positions. The footrests 38 are covered by carpeting made of a rubber-type material, for example, to provide additional comfort and traction for the feet of the riders.

A reboarding platform 40 is provided at the rear of the watercraft 10 on the deck 14 to allow the rider or a passenger to easily reboard the watercraft 10 from the water. Carpeting or some other suitable covering may cover the reboarding platform 40. A retractable ladder (not shown) may be affixed to a transom 47 of the stern 44 to facilitate boarding the watercraft 10 from the water onto the reboarding platform 40.

Referring to the bow 42 of the watercraft 10, as seen in FIG. 1, the watercraft 10 is provided with a hood 46 located forward of the seat 28 and a helm assembly 60. A hinge (not shown) is attached between a forward portion of the hood 46 and the deck 14 to allow the hood 46 to move to an open position to provide access to a front storage bin 24. A latch (not shown) located at a rearward portion of the hood 46 locks the hood 46 into a closed position. When in the closed position, the hood 46 prevents water from entering the front storage bin 24. Rearview mirrors 62 are positioned on either side of the hood 46 to allow the rider to see behind the watercraft 10.

As best seen in FIG. 2, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 77 are located on both sides of the hull 12 near the transom 47. The sponsons 77 have an arcuate undersurface that gives the watercraft 10 both lift while in motion and improved turning characteristics. The sponsons 77 are fixed to the surface of the hull 12 and can be attached to the hull 12 by fasteners or molded therewith. It is contemplated that the position of the sponsons 77 with respect to the hull 12 may be adjustable to change the handling characteristics of the watercraft 10 and accommodate different riding conditions.

The hull 12 has a tunnel 94 in which part of the jet propulsion system 50 is received. The tunnel 94 is defined at the front, sides and top by the hull 12 and is open at the transom 47. The bottom of the tunnel 94 is closed by a ride plate 96. The ride plate 96 creates a surface on which the watercraft 10 rides or planes at high speeds.

As best seen in FIG. 1, the helm assembly 60 is positioned forward of the seat 28. The helm assembly 60 has a central helm portion 64, that is padded, and a pair of steering handles 65, also referred to as a handlebar. One of the steering handles 65 is provided with a throttle operator which allows the rider to control the motor 22, and therefore the speed of the watercraft 10. The throttle operator is a finger-actuated throttle lever. However it is contemplated that the throttle operator could be a thumb-actuated throttle lever, a twist grip or other mechanism.

The throttle operator is movable between an idle position and multiple actuated positions. In the present embodiment, the throttle operator is biased towards the idle position, such that, should the driver of the watercraft 10 let go of the throttle operator, it will move to the idle position. The other of the steering handles 65 is provided with a reverse gate operator 67 used by the driver to actuate a reverse gate 74 (FIG. 4) in a fully lowered position for braking and/or reversing the watercraft 10. The reverse gate operator 67 (FIG. 1) is a finger-actuated lever. However, it is contemplated that the reverse gate operator 67 could be a thumb-actuated lever or a twist grip. The reverse gate 74 is pivotable about a gate axis 73 between a stowed position (shown in FIG. 4) and a fully lowered position where the reverse gate 74 redirects a jet of water expelled by the jet propulsion system 50. The reverse gate operator 67 communicates with an actuator 71, which in the present embodiment is an electric motor, which pivots the reverse gate 74 about the gate axis 73 in response to actuation of the reverse gate operator 67.

The helm assembly 60 is provided with a key receiving post located near a center of the central helm portion 64. The key receiving post is adapted to receive a key (not shown) that starts the watercraft 10. As is known, the key is typically attached to a safety lanyard (not shown). It should be noted that the key receiving post may be placed in any suitable location on the watercraft 10.

As shown schematically in FIG. 1, the motor 22 is supported by the hull 12 and is enclosed within a motor compartment 20 defined between the hull 12 and the deck 14. The motor 22 is configured for driving the jet propulsion system 50 (also commonly referred to as a "jet pump drive") which propels the watercraft 10. The motor compartment 20 accommodates the motor 22, as well as a muffler, gas tank, electrical system (battery, electronic control unit, etc.), air box, storage bins 24, 26, and other elements required or desirable in the watercraft 10.

In this embodiment, the motor 22 is an internal combustion engine 22 and will thus be referred to as the engine 22. However, it is contemplated that, in alternative embodiments, the engine 22 may be any other suitable type of motor such as an electric motor. As will be understood, in such an embodiment, certain components would be added to or omitted from the watercraft 10 (e.g., no muffler and gas tank, etc.).

The engine 22 has a crankshaft (not shown) that extends longitudinally. A gearbox 25 is connected to the crankshaft and is disposed in the motor compartment 20 rearward of the engine 22. A driveshaft 55 is connected to the gearbox 25 and is connected to the jet propulsion system 50 as will be described further below.

The gearbox 25 is operable to selectively change a direction of rotation of the driveshaft 55. Notably, the gearbox 25 can selectively rotate the driveshaft 55 clockwise or counter clockwise by engaging different gearing to drive the driveshaft 55.

The watercraft 10 is propelled by the jet propulsion system 50 which pressurizes water to create thrust. To that end, the jet propulsion system 50 has a duct 52 (FIGS. 1 to 3) in which water is pressurized and which is defined by various components of the jet propulsion system 50.

Figure 3:
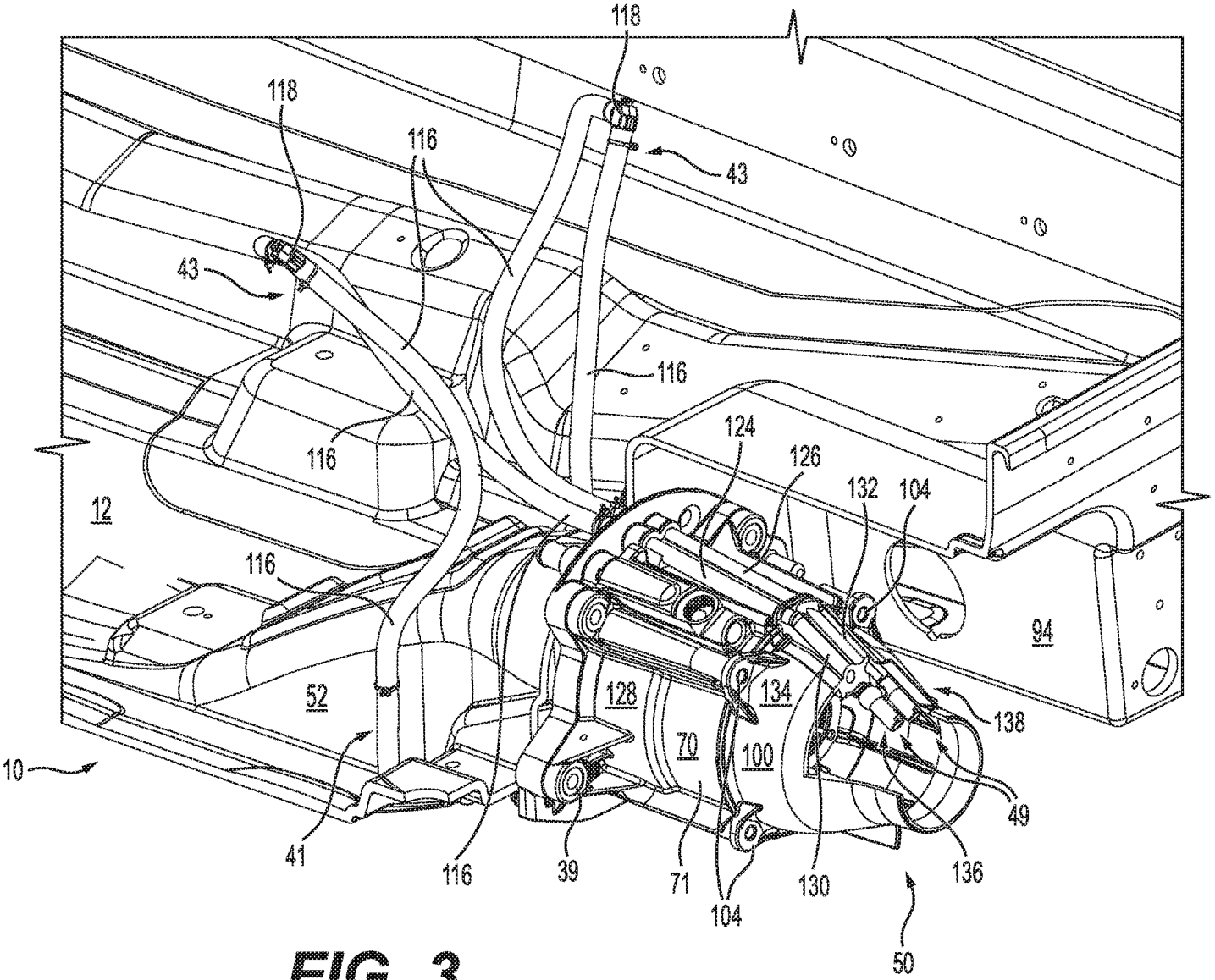
FIG. 3 is a perspective longitudinal section view of a hull of the watercraft of FIG. 1, taken from a rear, left side, and showing a jet propulsion system of the watercraft of FIG. 1 with a steering nozzle, a reverse gate, and other components removed therefrom.

Referring to FIGS. 2 and 3, the duct 52 is defined in part by an intake ramp 58, an impeller housing 70, a venturi unit 100 and a steering nozzle 102 of the jet propulsion system 50. As shown in FIG. 2, the duct 52 has an inlet 86 positioned under the hull 12. When the jet propulsion system 50 propels water rearward, water from outside of the watercraft 10 is first scooped into the inlet 86. An inlet grate 54 is positioned adjacent (i.e., at or near to) the inlet 86 and is configured to prevent large rocks, weeds, and other debris from entering the water jet propulsion system 50, which may damage the system or negatively affect performance. It is contemplated that the inlet grate 54 could be positioned in the inlet 86. Water flows from the inlet 86 through the water intake ramp 58 and into impeller housing 70.

Figure 4:
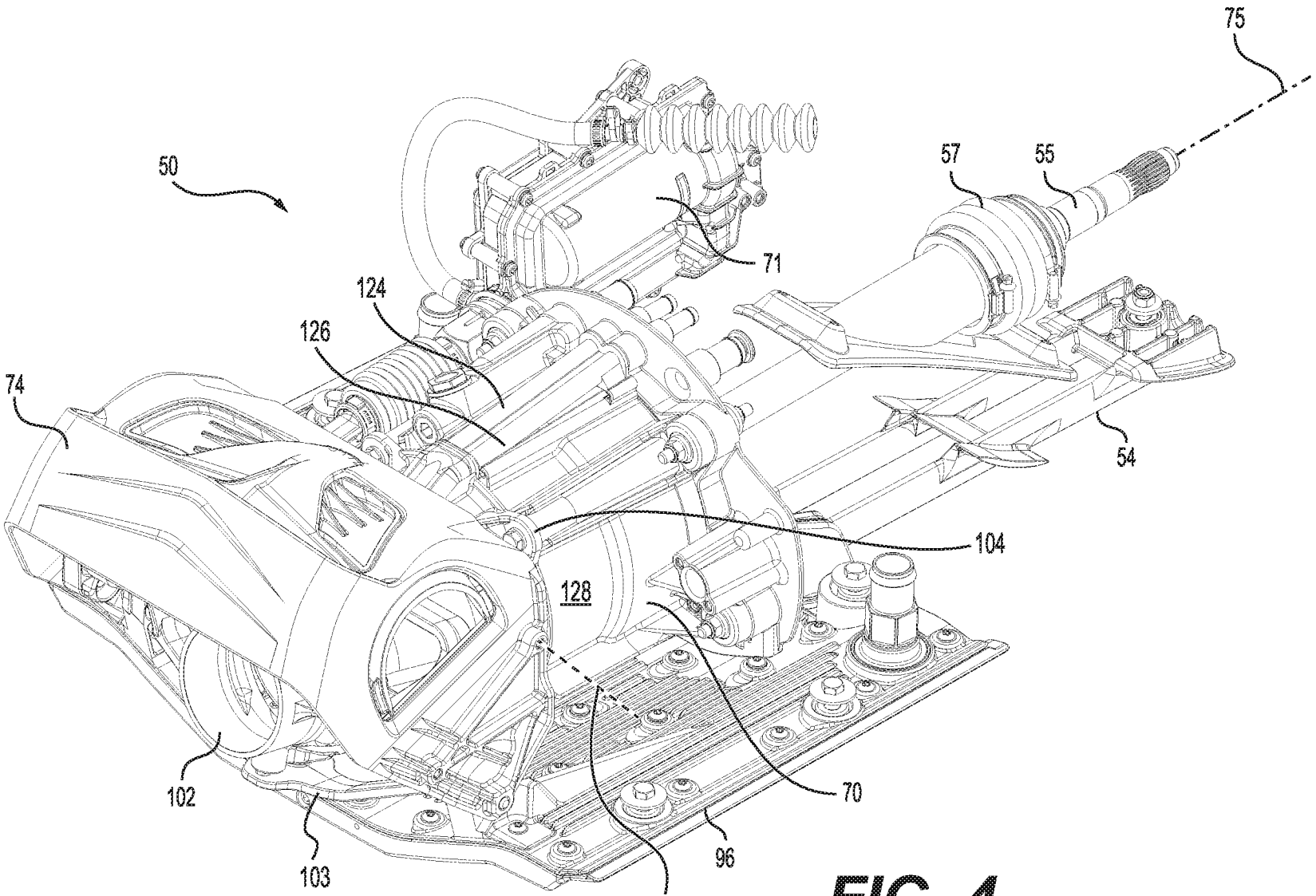
FIG. 4 is a perspective view, taken from a rear, right side, of the jet propulsion system of FIG. 3.

As shown in FIG. 3, the impeller housing 70 is located in the tunnel 94 of the hull 12 and is fastened to the tunnel 94 via bolts that engage openings 39 in the impeller housing 70 and corresponding openings in the front wall of the tunnel 94. In turn, the venturi unit 100 is connected to the impeller housing 70 and is positioned rearward thereof such that the venturi unit 100 is positioned longitudinally between the impeller housing 70 and the steering nozzle 102 (FIG. 4). To this end, the venturi unit 100 has mounting flanges 104 that are evenly circumferentially spaced around a front end of the venturi unit 100. Fasteners (e.g., bolts) are inserted into openings provided in the mounting flanges 104 and into corresponding openings in the impeller housing 70 in order to secure the venturi unit 100 to the impeller housing 70.

Figure 6:
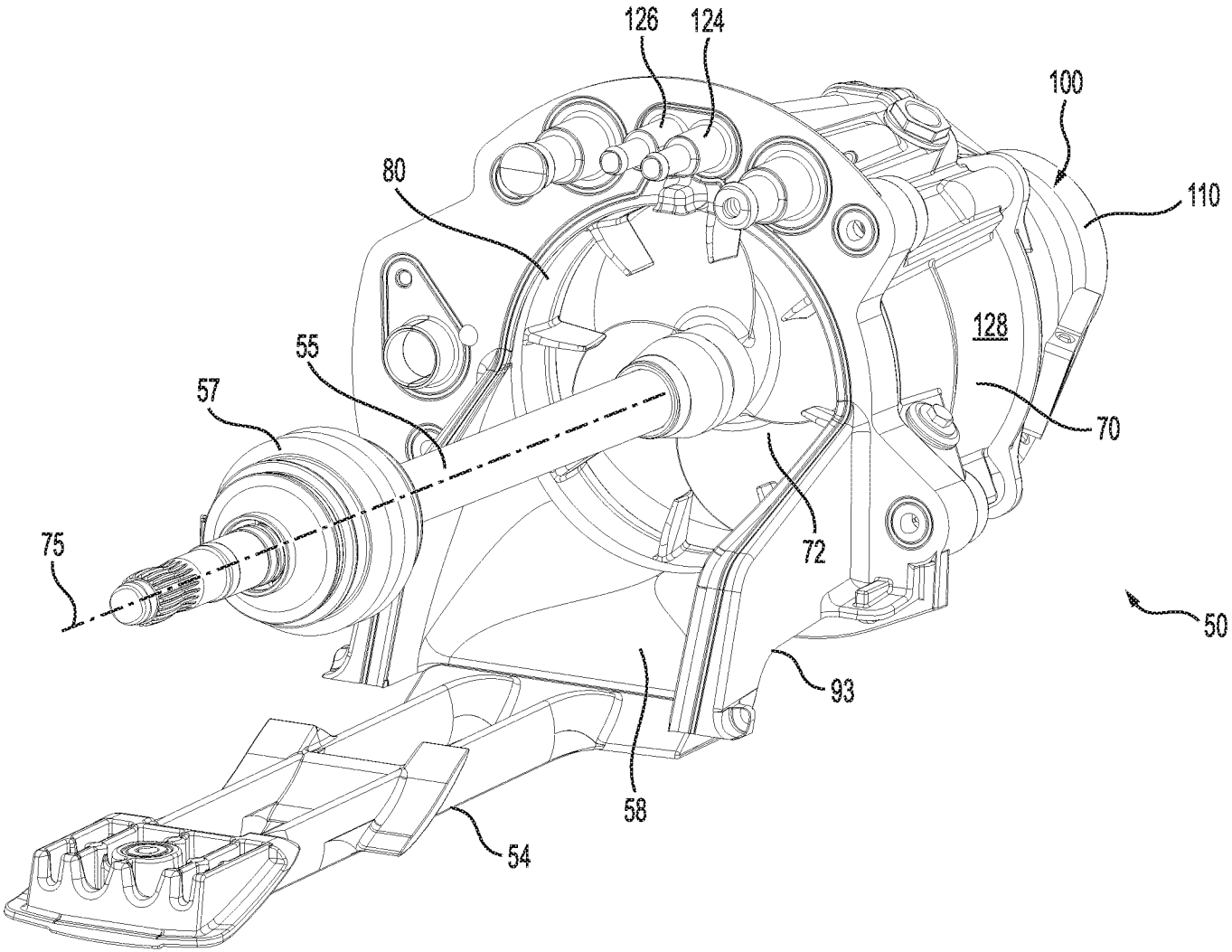
FIG. 6 is a perspective view, taken from a front, left side, of the components of the jet propulsion system of FIG. 5.

Referring to FIG. 6, the impeller housing 70 houses an impeller 72. The impeller 72 is mounted to the driveshaft 55 such that the impeller 72 is rotated about an impeller rotation axis 75 defined by the driveshaft 55. The impeller 72 is thus operatively connected to the engine 22 via the driveshaft 55 and the gearbox 25. Since the gearbox 25 can selectively rotate the driveshaft 55 clockwise or counter-clockwise about the impeller rotation axis 75, the impeller 72 can be rotated in a "forward direction" or in a "reverse direction". The impeller 72 is positioned rearward of the intake ramp 58 such that, when the impeller 72 rotates in the forward direction, the impeller 72 propels water rearward along the duct 52 into the venturi unit 100.

As such, when the impeller 72 rotates in the forward direction it pulls water into the duct 52 via the inlet grate 54 and propels it rearward through the impeller housing 70 and out of the venturi unit 100, thereby propelling the watercraft 10 forward. The venturi unit 100 is configured to constrict this water flow in order to increase water speed. To this end, and referring to FIGS. 7 and 8, the venturi unit 100 forms a venturi conduit 106 which defines the venturi inlet 108 and a venturi outlet 110 opposite the venturi inlet 108. The venturi conduit 106 also has a plurality of vanes 112, only a few of which are labeled to maintain clarity. The vanes 112 decrease rotational motion of water flowing through the venturi conduit 106 so that energy given to the water by the impeller 72 is used for thrust, as opposed to swirling the water.

In order to constrict water flow, the venturi inlet 108 has a greater cross-sectional area than the venturi outlet 110 such that the venturi conduit 106 is generally frustoconical in shape and has a generally frustoconical peripheral wall 114. Thus, when the impeller 72 rotates in the forward direction propelling water through the venturi inlet 108 and then out of the venturi outlet 110, the speed of the water flowing through the venturi conduit 106 increases due to the reduction in diameter of the venturi conduit 106 from the venturi inlet 108 to the venturi outlet 110. This increases thrust.

Referring back to FIG. 4, the steering nozzle 102 is disposed rearward of the venturi unit 100 and directs the thrust and provides for steering and trim of the watercraft 10. More particularly, a variable trim system (VTS) support 103 is pivotally mounted relative to the venturi unit 100 about a VTS axis 105 (shown in the embodiment of FIG. 28). The steering nozzle 102 is pivotally mounted to the to the VTS support 103 so as to pivot about a steering axis 107 (shown in the embodiment of FIG. 28). The steering axis 107 is perpendicular to the VTS axis 105. The steering nozzle 102 is operatively connected to the helm assembly 60 via a push-pull cable (not shown) such that when the helm assembly 60 is turned, the steering nozzle 102 pivots about the steering axis 107.

Movement of the steering nozzle 102 about the steering axis 107 redirects the pressurized water coming from the venturi outlet 110 and steers the watercraft 10. Movement of the steering nozzle 102 about the VTS axis 105 together with the VTS support 103 is known as trim and controls the pitch of the watercraft 10. In the present embodiment, the steering nozzle 102 has a plurality of trim-up positions (i.e. the steering nozzle points up relative to the axis 75) and a plurality of trim-down positions (i.e. the steering nozzle 102 points down relative to the axis 75). In alternative embodiments, the steering nozzle 102 could be supported at the exit of the tunnel 94 in other ways without a direct connection to the venturi unit 100. It is also contemplated that the steering nozzle 102 could also be replaced by a rudder or other diverting mechanism disposed at the exit of the tunnel 94 to selectively direct the thrust generated by the jet propulsion system 50.

In the present embodiment, the reverse gate 74 is operatively connected to the VTS support 103 such that rotation of the reverse gate 74 about the gate axis 73 results in rotation of the VTS support 103, and the steering nozzle 102, about the VTS axis 105. As such, the actuator 71 controls both the position of the reverse gate 74 and the trim position of the steering nozzle 102. A detailed description of a variable trim system and gate assembly of this type can be found in U.S. Pat. No. 9,376,189, issued Jun. 28, 2016, the entirety of which is incorporated herein by reference. It is contemplated that movement of the reverse gate 74 about the gate axis 73 and movement of the VTS support 103 about the VTS axis 105 could be done independently from one another by different actuators. It is also contemplated that in some embodiments that the reverse gate 74 could be omitted. It is also contemplated that in some embodiments the VTS support 73 could be omitted such that the steering nozzle 102 can only pivot about the steering axis 107 and cannot be trimmed.

The jet propulsion system 50 can also be operated in reverse to propel water forward along the duct 52 in order to clear foreign bodies clogging the duct 52, the inlet grate 54, or other parts of the jet propulsion system 50. Rotation of the impeller 72 in the reverse direction about the impeller rotation axis 75 pulls water into the venturi outlet 110 and propels it forward through the venturi inlet 108 and then out of the inlet grate 54.

Referring to FIGS. 1 and 3, the jet propulsion system 50 is connected to and operates a bailer-siphon system 41 of the watercraft 10. In summary, the bailer-siphon system 41 draws water from the motor compartment 20 while the watercraft 10 is propelled by the impeller 72 rotating in the forward direction, by using suction created by water flowing out of the venturi outlet 110. On the other hand, when the impeller 72 is rotating in the reverse direction, the bailer-siphon system 41 is fluidly disconnected from the venturi unit 100, thereby reducing or eliminating aeration of the impeller 72 which may have otherwise been caused by the fluid connection to the bailer-siphon system and improving thrust for clearing foreign objects. How this functionality is achieved is described next.

Referring to FIG. 1, the bailer-siphon system 41 includes two fluid conduits 43 defined by various elements, as described later in this document. The two fluid conduits 43 are similar to each other. To maintain clarity, only one of the two fluid conduits 43 has been schematically shown in FIG. 1. It is contemplated that the bailer-siphon system 41 could have a single fluid conduit 43, or more than the two fluid conduits 43, with a corresponding number of fluid inlet(s) 45 and fluid outlet(s) 49.

In the present embodiment, each of the two fluid conduits 43 has a fluid inlet 45 and a fluid outlet 49. The fluid inlets 45, also referred to as bailer pickups, are positioned at or proximate to a bottom, rear surface of the motor compartment 20 for drawing water out of the motor compartment 20. The fluid outlets 49 are positioned at the venturi unit 100 and are in fluid communication with the venturi outlet 110 at least when the impeller 72 rotates in the forward direction while the watercraft 10 is in use.

Water propelled through the venturi conduit 106 from the venturi inlet 108 toward and out of the venturi outlet 110 creates suction at the fluid outlets 49 of the bailer-siphon system 41 and thereby draws water out the motor compartment 20 via the fluid inlets 45. Water, and any air, that may be drawn in from the motor compartment 20 is expelled out of the venturi outlet 110 with the main flow of water created by the impeller 72. Since in this operating condition the flow of water is directed from the impeller 72 toward the venturi outlet 110, any air introduced into the flow of water at the venturi unit 100 by the bailer-siphon system 41 exits the venturi unit 100 without flowing over the impeller 72.

Referring to FIG. 3, each of the fluid conduits 43 is defined in part by a set of rubber hoses 116 extending above the jet propulsion system 50 and being fluidly interconnected by a siphon break 118 which ensures that water from outside of the watercraft 10 is not suctioned into the motor compartment 20. It is contemplated that any suitable number and/or arrangement of hoses or other elements, such as plastic tubes, could be used to define the fluid conduits 43.

In the present embodiment, and still referring to FIG. 3, the hoses 116 extending between the siphon breaks 118 and the impeller housing 70 are fluidly connected at their respective rear ends to respective ones of tubes 124, 126 that are defined by a peripheral wall 128 of the impeller housing 70. In turn, at their rear ends the tubes 124, 126 are fluidly connected to respective ones of tubes 130, 132 defined by a peripheral wall 134 of the venturi unit 100. More particularly, in the present embodiment, the tubes 130, 132 are defined in a removable portion of the peripheral wall 134 at a top side of the peripheral wall 134. It is contemplated that the peripheral wall 134 could be made of a single piece of material.

Lastly, at their rear ends, the tubes 130, 132 of the venturi unit 100 are selectively fluidly connected to a valve 136 that defines the fluid outlets 49 of the bailer-siphon system 41. Still referring to FIG. 3, in the present embodiment the valve 136 is disposed at the venturi unit 100, radially inward of the peripheral wall 134. The valve 136 is operable between an open position 138 (FIGS. 3, 7, and 10-12), and a closed position 140 (FIGS. 8 and 13-14).

Figure 9:
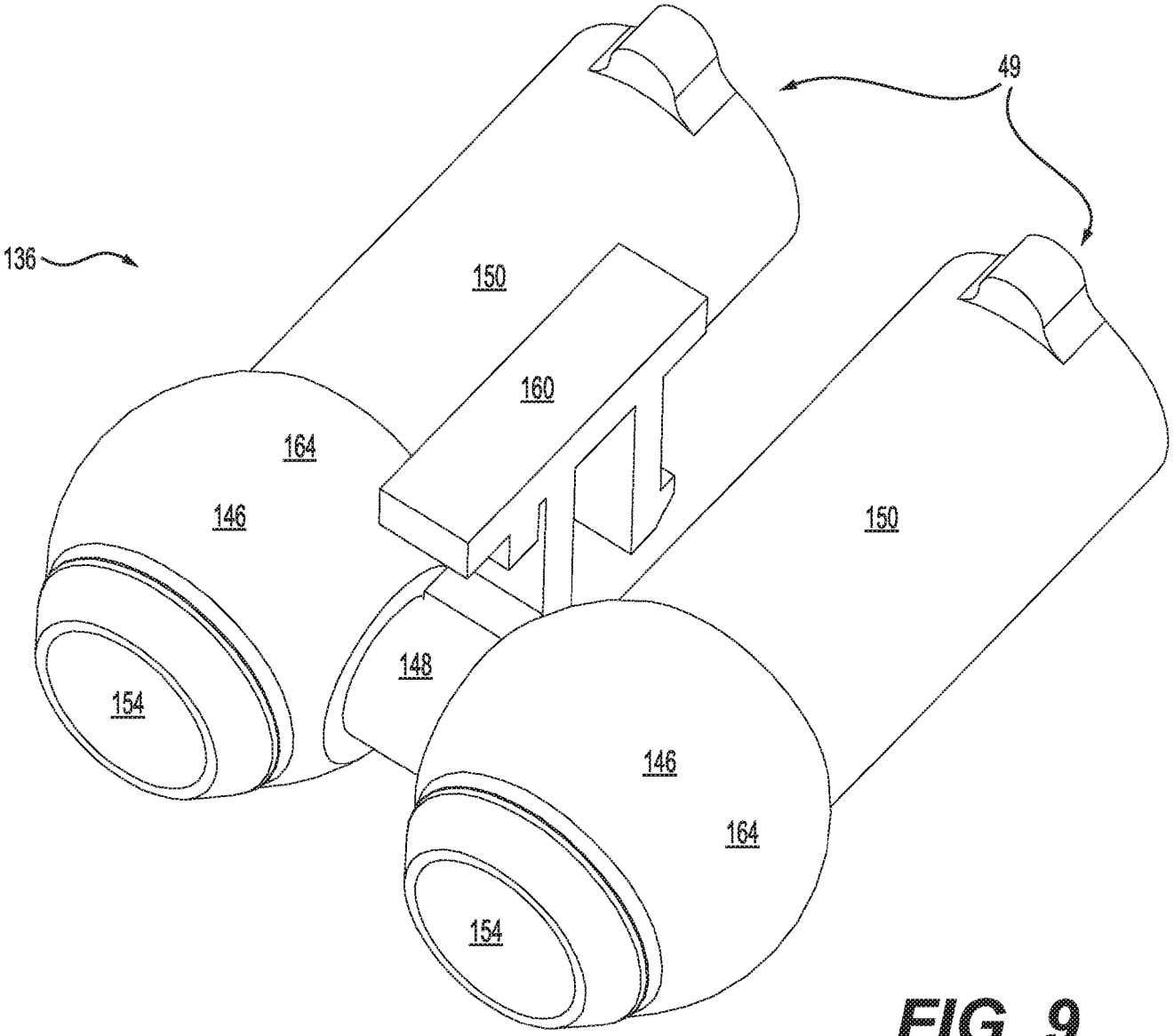
FIG. 9 is a perspective view, taken from a front, top, left side, of the valve of the venturi unit of FIG. 7.
Figure 10:
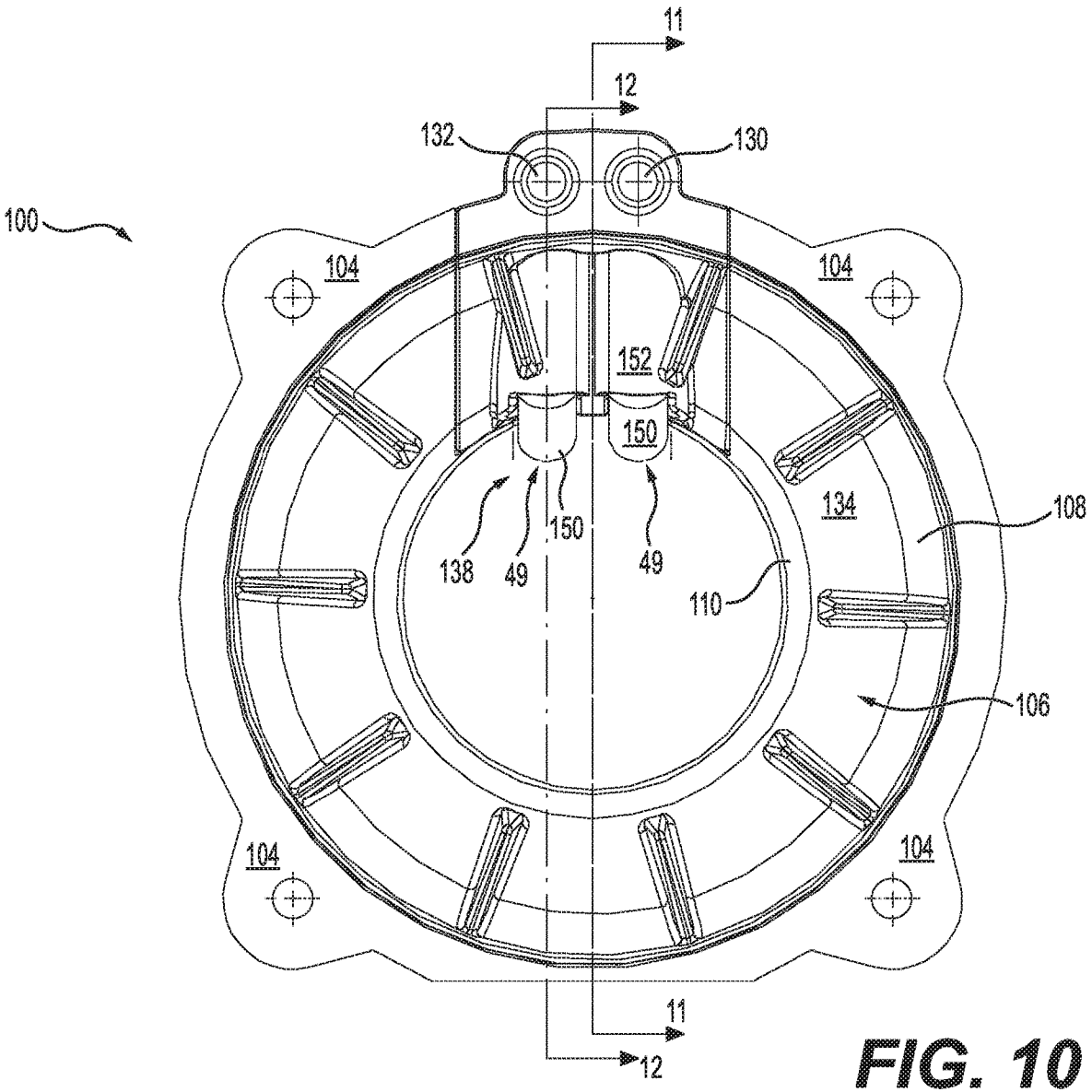
FIG. 10 is a front elevation view of the venturi unit of FIG. 7.

As shown in FIG. 9, in this embodiment, the valve 136 includes two ball portions 146 joined by a cylindrical post 148, and two tubes 150. The tubes 150 are free at their rear ends and are attached at their front ends to respective ones of the ball portions 146 to pivot together with the ball portions 146. The free rear ends of the tubes 150 define the fluid outlets 49 of the bailer-siphon system 41.

The ball portions 146 are received in respective portions of a seat 152 (FIGS. 7, 8 and 10) defined by the peripheral wall 134 of the venturi unit 100. The ball portions 146 define apertures 154 therethrough. The apertures 154 align with the apertures 156 (FIG. 8) in the respective ones of the tubes 150. When the valve 136 is in the open position 138, the apertures 154 of the ball portions 146 align with the respective ones of the apertures (not separately labeled) in the tubes 130, 132 of the venturi unit 100 and thereby fluidly connect the fluid outlets 49 of the bailer-siphon system 41 to the respective fluid inlets 45 of the bailer-siphon system 41. In the closed position 140, an outer surface 164 (FIG. 9) of each of the ball portions 146 blocks a respective one of the tubes 130, 132 and thereby fluidly disconnects the fluid outlets 49 from the fluid inlets 45.

Figure 5:
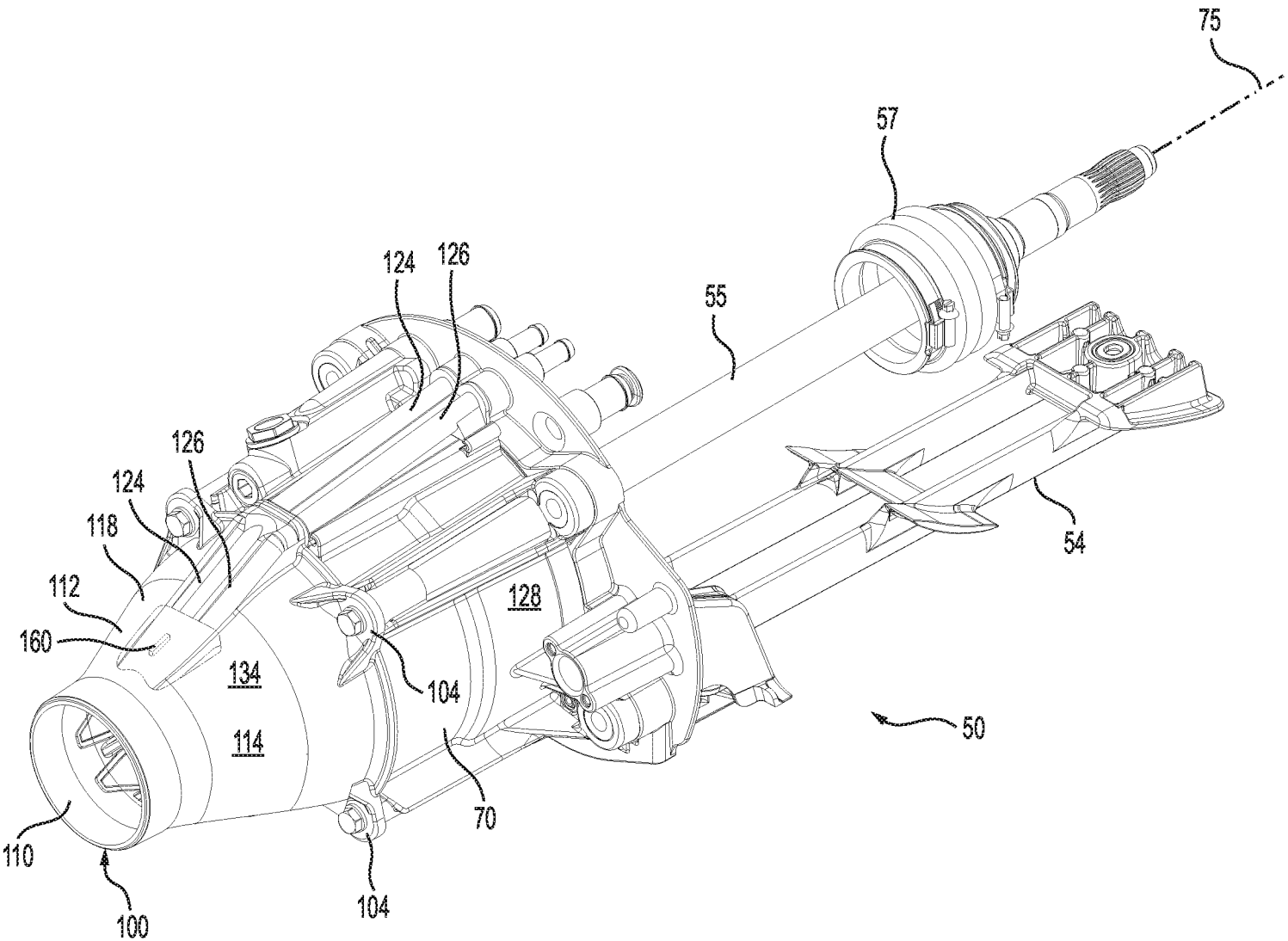
FIG. 5 is a perspective view, taken from a rear, right side, of components of the jet propulsion system of FIG. 4.
Figure 11:
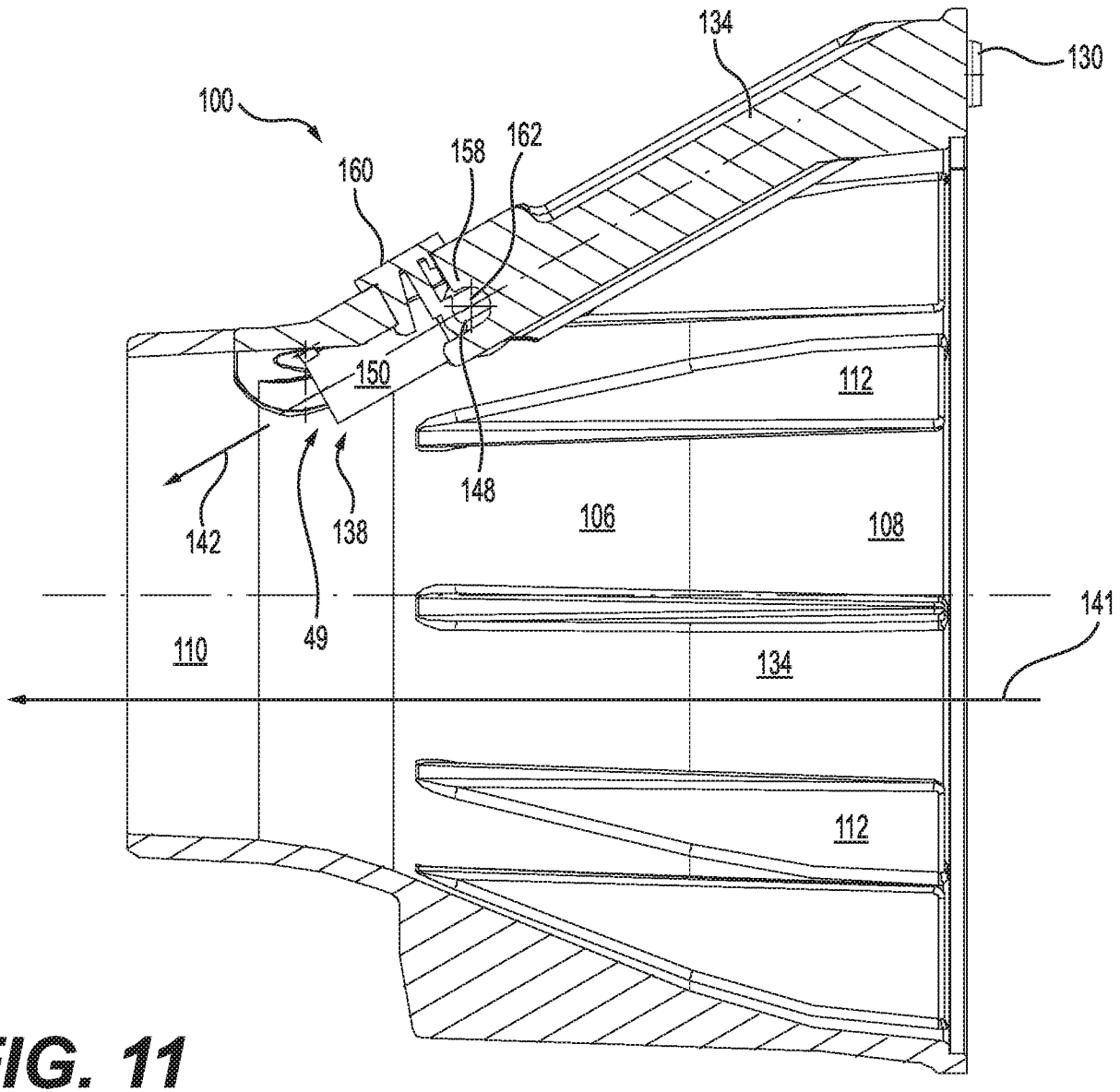
FIG. 11 is a cross-sectional view of the venturi unit of FIG. 10, taken along section line 11-11 in FIG. 10, with the valve being in the open position.
Figure 13:
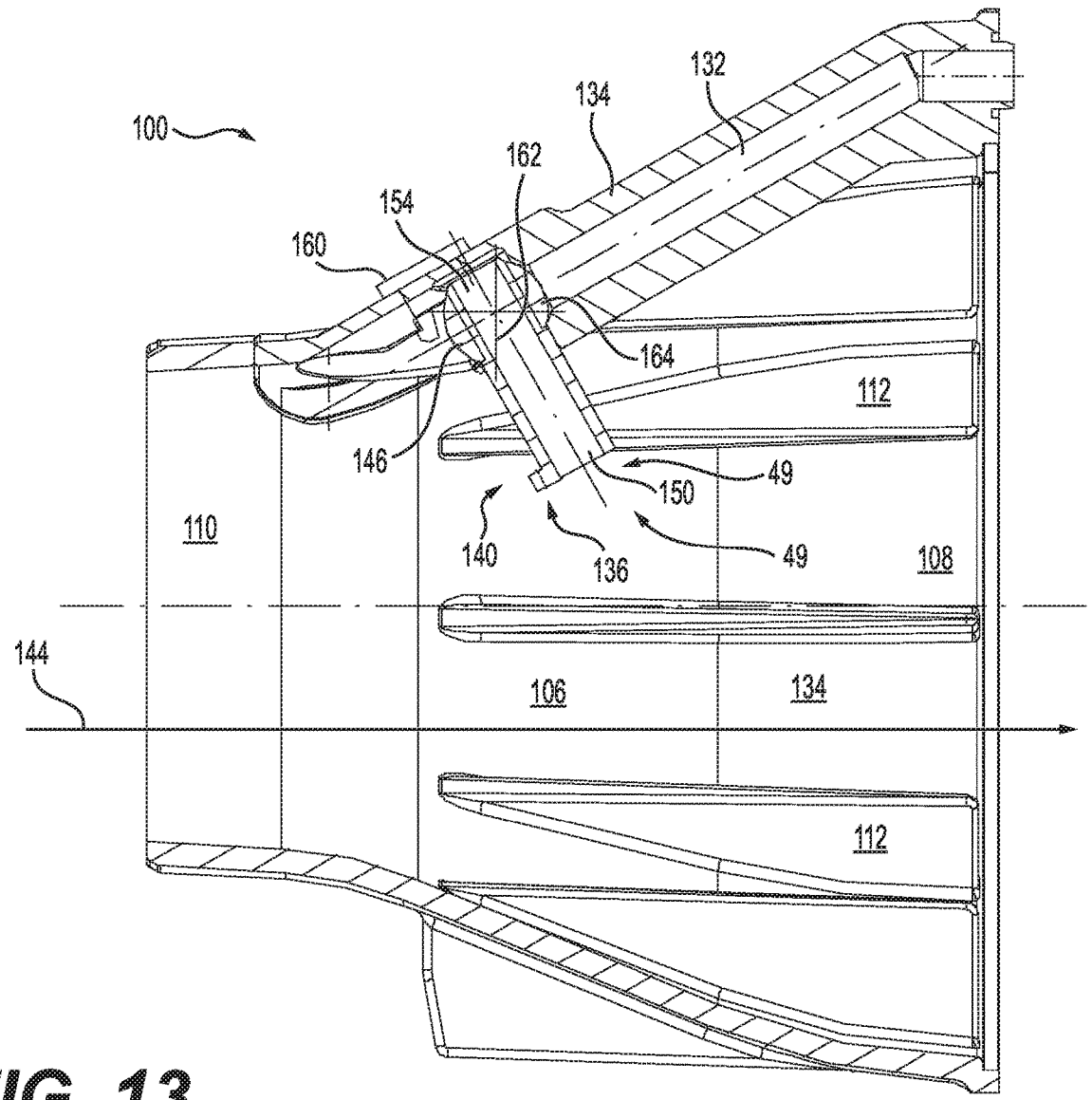
FIG. 13 is a cross-sectional view of the venturi unit of FIG. 10, taken along section line 12-12 in FIG. 10, with the valve being in the closed position.
Figure 14:
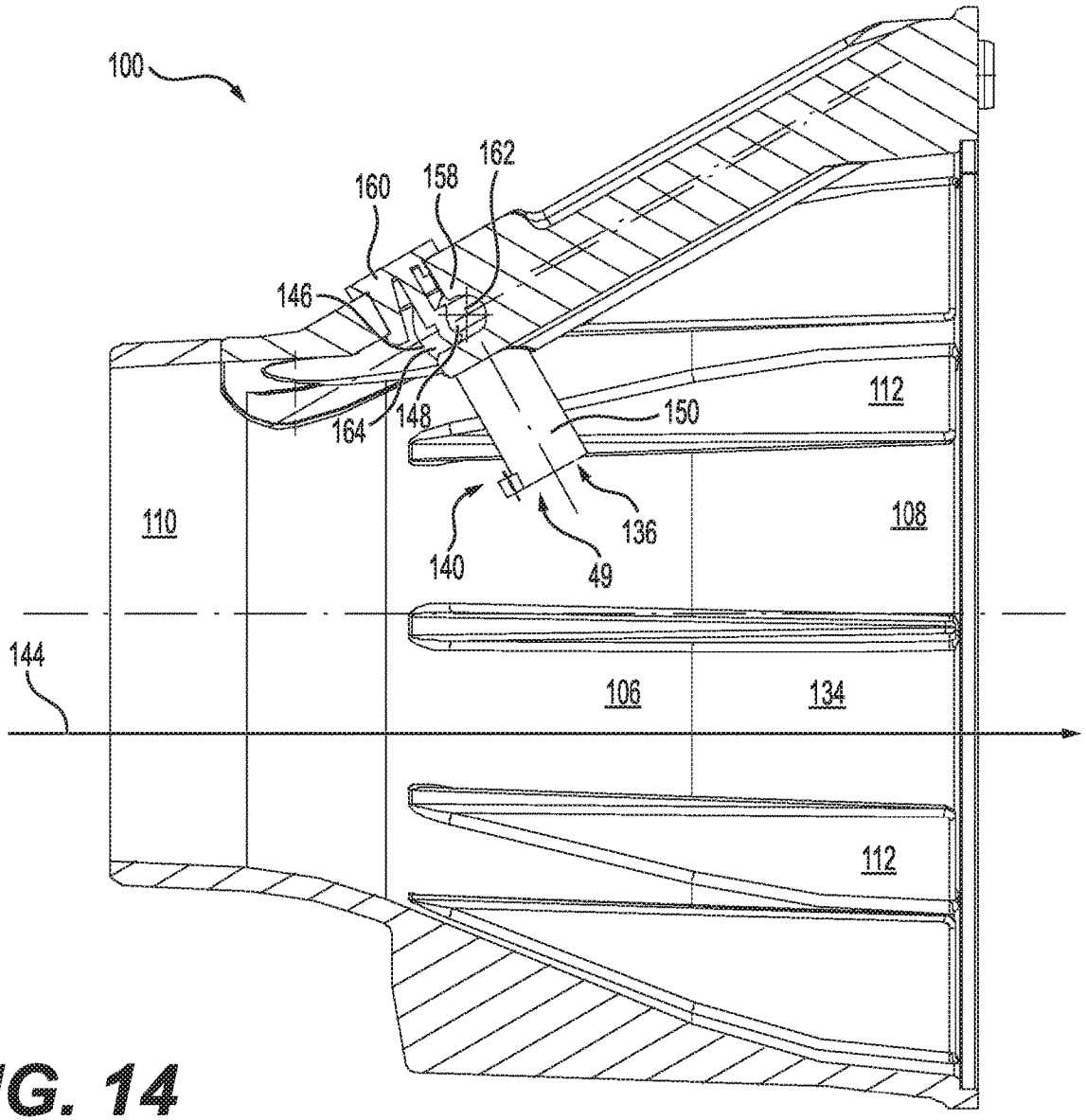
FIG. 14 is a cross-sectional view of the venturi unit of FIG. 10, taken along section line 11-11 in FIG. 10, with the valve being in the closed position.

As shown in FIGS. 11 and 14, the cylindrical post 148 of the valve 136 is received in a congruently shaped recess 158 defined by the peripheral wall 134 of the venturi unit 100. The recess 158 is defined in the peripheral wall 134 between the portions of the seat 152 that receive the ball portions 146. As shown in FIGS. 5, 11 and 14, a clip 160 is received through and retained in an aperture defined through the peripheral wall 134 above and rearward of the recess 158. The clip 160 pushes the cylindrical post 148 into the recess 158. This construction allows the valve 136 to pivot about a pivot axis 162 (FIGS. 11-14) defined by the cylindrical post 148 between the open position 138 and the closed position 140 while keeping the valve 136 in place. The clip 160 is an example of a resilient member. It is contemplated that a different resilient member and/or a different pivot connection could be used.

When the watercraft 10 is in use and is being propelled by thrust generated by the impeller 72 rotating in the forward direction, a rearward flow 141 (FIGS. 7, 11 and 12) of water is generated through the venturi conduit 106 from the venturi inlet 108 toward the venturi outlet 110. If the valve 136 is at that moment in the closed position 140, the rearward flow 141 acts on the tubes 150 and thereby pivots the valve 136 from the closed position 140 to the open position 138. If the valve 136 is already in the open position 138, the rearward flow 141 ensures that the valve 136 stays in the open position 138. When the valve 136 is in the open position 138, the fluid outlets 49 of the bailer-siphon system 41 are fluidly connected to the respective fluid inlets 45 of the bailer-siphon system 41. In addition, the tubes 150 are oriented such that the fluid outlets 49 open in a direction substantially locally parallel to the rearward flow 141 through the venturi conduit 106. Accordingly, the rearward flow 141 passing the valve 136 creates suction at the fluid outlets 49 and draws water and/or air out of the motor compartment 20 via the fluid inlets 45 of the bailer-siphon system 41. This water and/or air is expelled via the valve 136 into the water jet leaving the venturi outlet 110.

Figure 7:
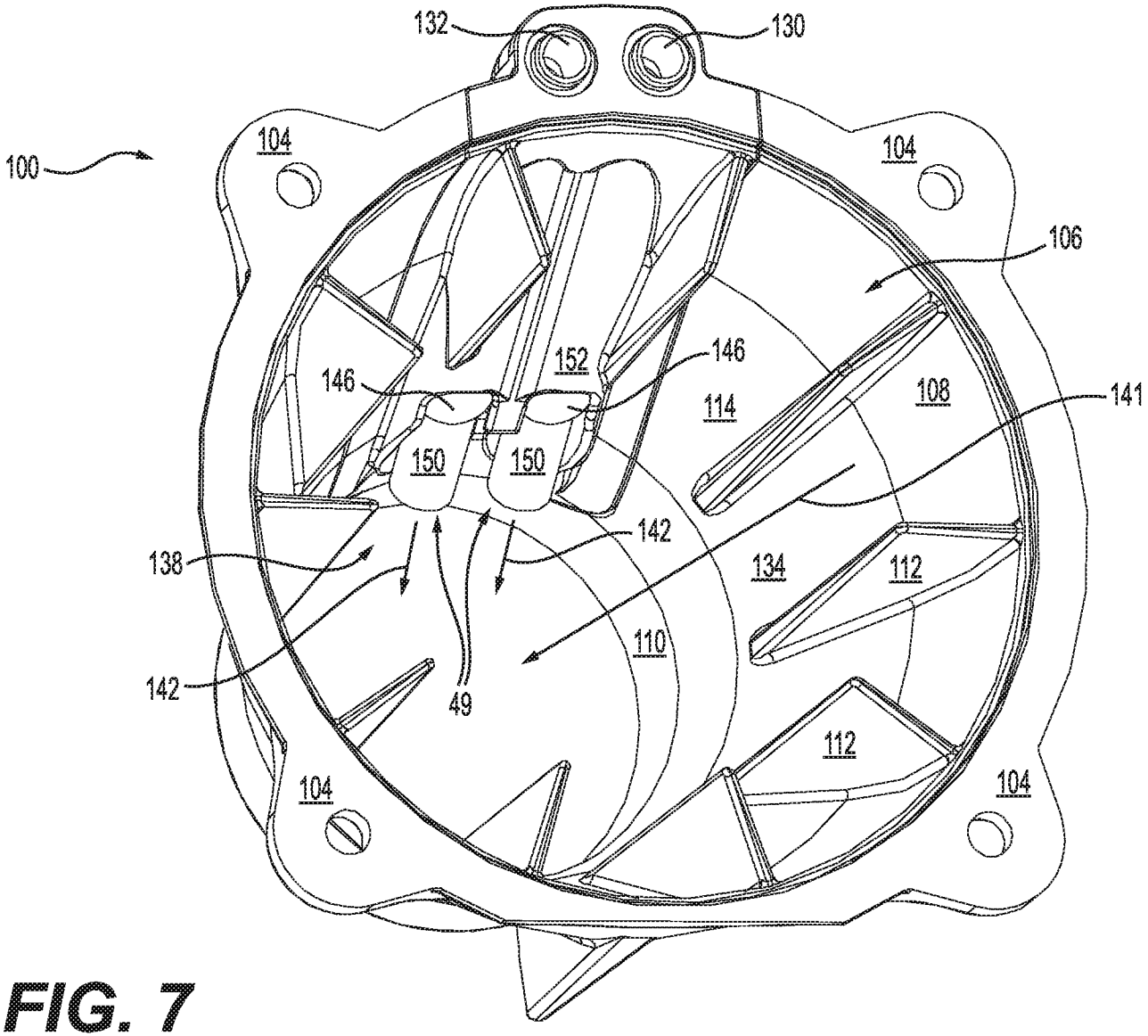
FIG. 7 is a perspective view, taken from a front, bottom, right side, of a venturi unit of the jet propulsion system of FIG. 3, with a valve of the venturi unit being in an open position.
Figure 8:
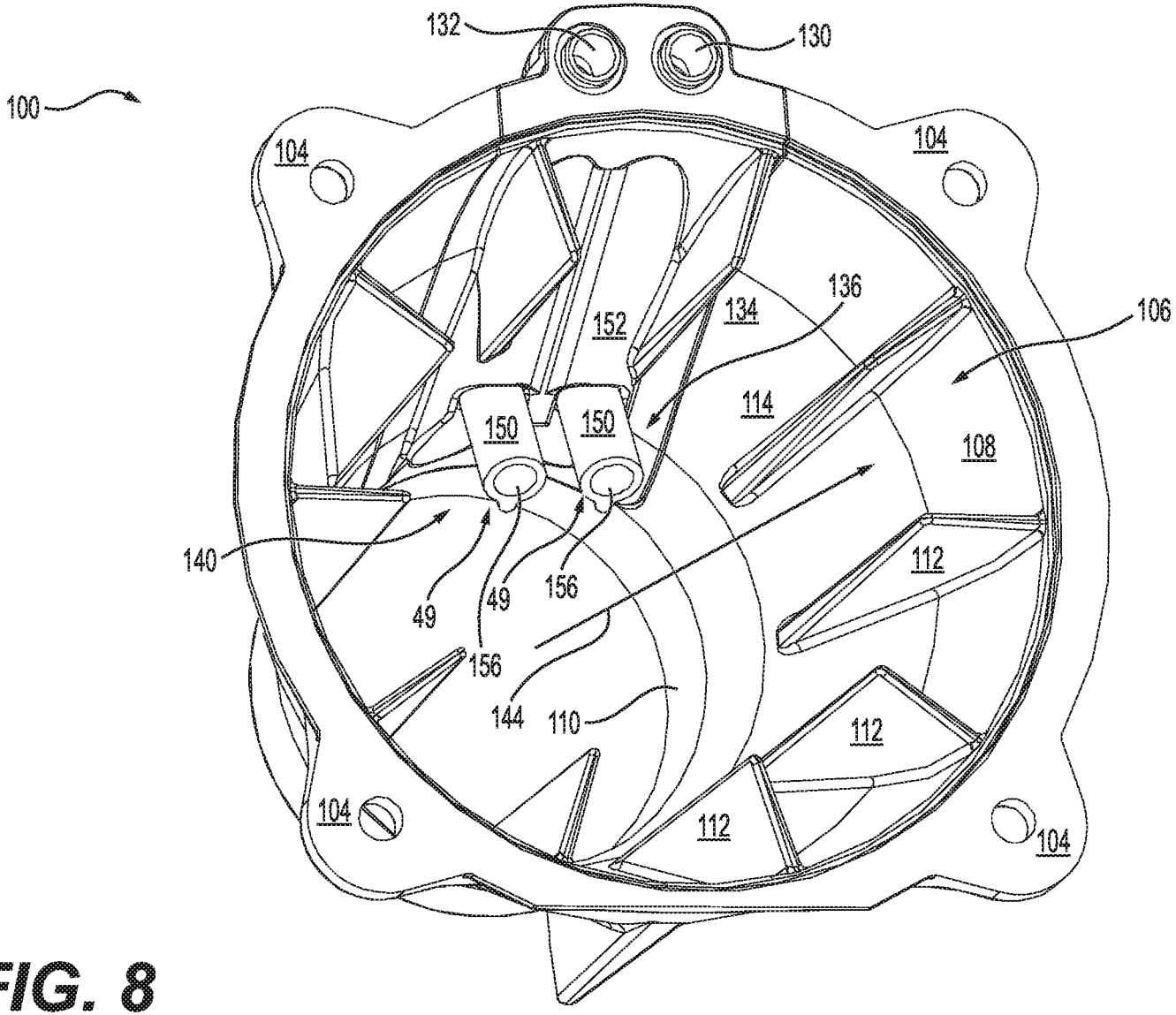
FIG. 8 is a perspective view, taken from a front, bottom, right side, of the venturi unit of FIG. 7, with the valve of the venturi unit being in a closed position.
Figure 12:
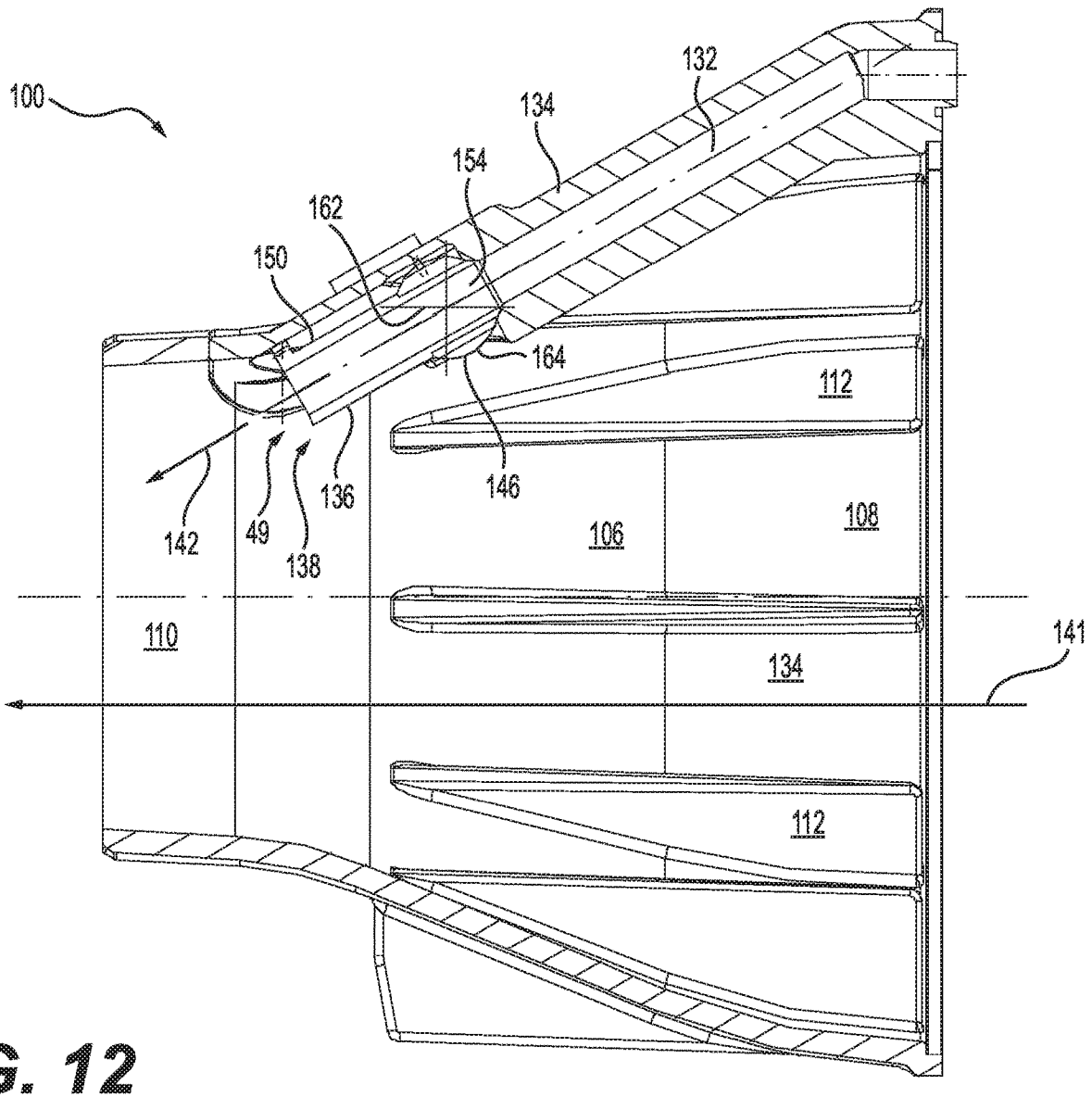
FIG. 12 is a cross-sectional view of the venturi unit of FIG. 10, taken along section line 12-12 in FIG. 10, with the valve being in the open position.

A flow of water and/or air from the motor compartment 20 out of the valve 136 is shown with arrows 142 in FIGS. 7, 11 and 12. In this mode of operation, any air drawn from the motor compartment 20 via the bailer-siphon system 41 exits the valve 136 and leaves the venturi unit 100 via the venturi outlet 110 with the flow 141 of water and does not aerate the impeller 72.

On the other hand, when the watercraft 10 is in use and the impeller 72 is rotating in the reverse direction for clearing debris out of the jet propulsion system 50, a forward flow 144 (FIGS. 8, 13 and 14) of water is generated through the venturi conduit 106 from the venturi outlet 110 toward the venturi inlet 108. If the valve 136 is at that moment in the open position 138, the forward flow 144 acts on the tubes 150 and thereby pivots the valve 136 about the pivot axis 162 from the open position 138 to the closed position 140. If the valve 136 is already in the closed position 140, the forward flow 144 ensures that the valve 138 stays in the closed position. As seen from FIGS. 11 and 14, due to the action of the clip 160, the cylindrical post 148 stays in the recess 158 during the pivoting movement of the valve 136 between the open position 138 and the closed position 140.

In the closed position 140, the valve 136 fluidly disconnects the tubes 130, 132 from the venturi outlet 110, and therefore disconnects the fluid outlets 49 of the bailer-siphon system 41 from the fluid inlets 45 of the bailer-siphon system 41. This prevents air from being drawn into the venturi unit 100 via the bailer-siphon system 41 and thus prevents the impeller 72 from being aerated via the bailer-siphon system 41 while the impeller 72 is rotating in the reverse direction.

As seen from the above, the tubes 150 are an example of elements used to harvest energy from the flows of water through the venturi conduit 106 in order to operate the valve 136 between the closed position 140 and the open position 138. It is contemplated that a different type of element could be used.

Reference is now made to FIGS. 15 to 21, which show a venturi unit 200. The venturi unit 200 is an alternative embodiment of the venturi unit 100 and operates on a similar principles. Parts of the venturi unit 200 that are similar to corresponding parts of the venturi unit 100 have been labeled with the same corresponding reference numerals and will not be described again in detail.

One difference between the venturi unit 200 and the venturi unit 100 is that the venturi unit 200 defines a pair of channels 202, 204 that fluidly connect to respective ones of the tubes 124, 126 of the impeller housing 70. The channels 202, 204 have respective rear ends 206, 208 that are open on the inner side of the peripheral wall 210 of the venturi unit 200, as best shown in FIGS. 16 and 18 to 21. The rear ends 206, 208 of the channels 202, 204 define the fluid outlets 49 of the bailer-siphon system 41.

Figure 15:
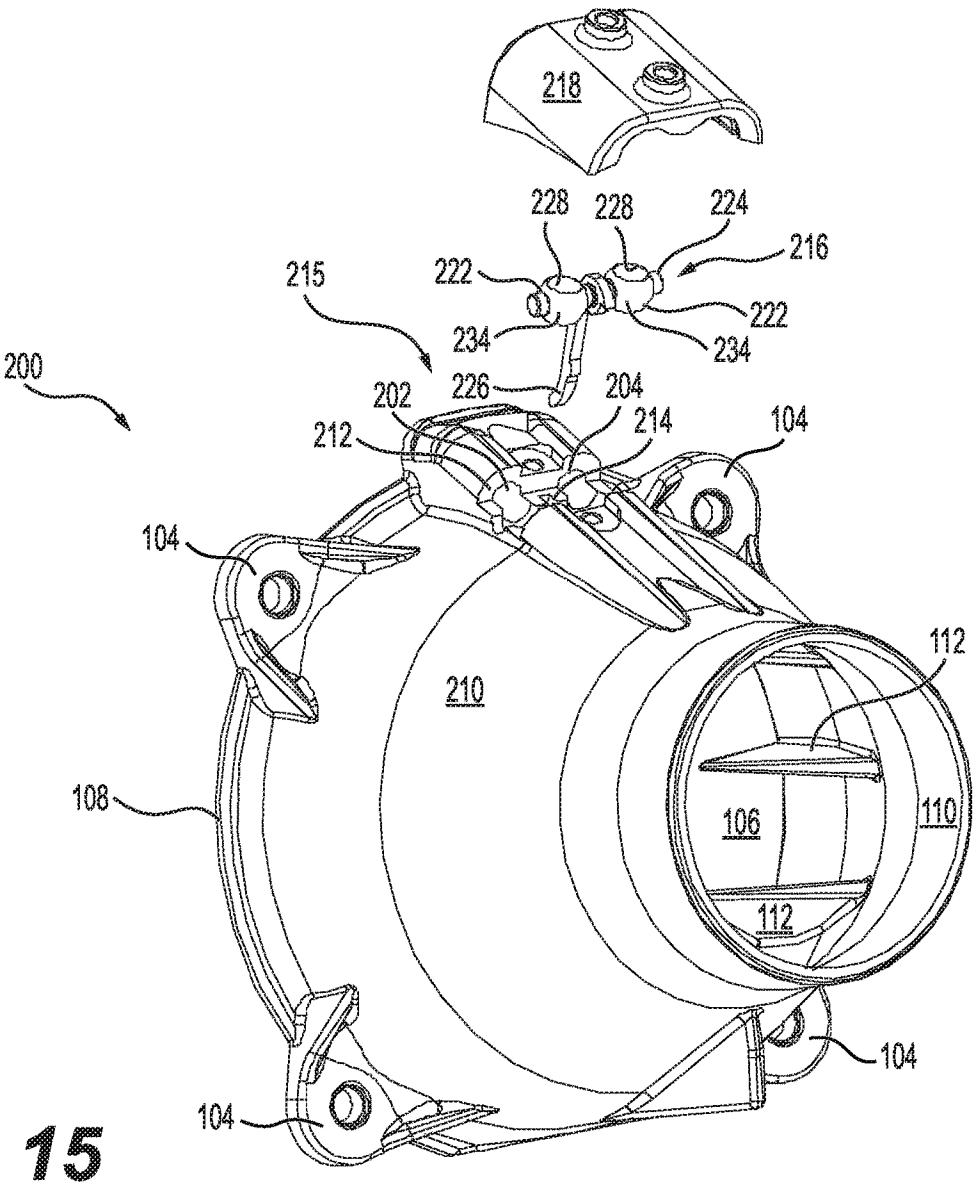
FIG. 15 is an exploded view, taken from a rear, left side, of a venturi unit of the jet propulsion system of FIG. 3, according to another embodiment.

As shown in FIG. 15, the channels 202, 204 define a first part 212 of a seat 215 on a top side of the peripheral wall 210 of the venturi unit 200. The first part 212 of the seat 215 defines an aperture 214 between the channels 202, 204. The aperture 214 extends through the peripheral wall 210 of the venturi unit 200, peripherally inward into the venturi conduit 106. The first part 212 of the seat 215 and the aperture 214 receive a valve 216 of the venturi unit 200. The valve 216 is thus disposed forward of the fluid outlets 49, between the fluid inlets 45 and the fluid outlets 49.

Figure 16:
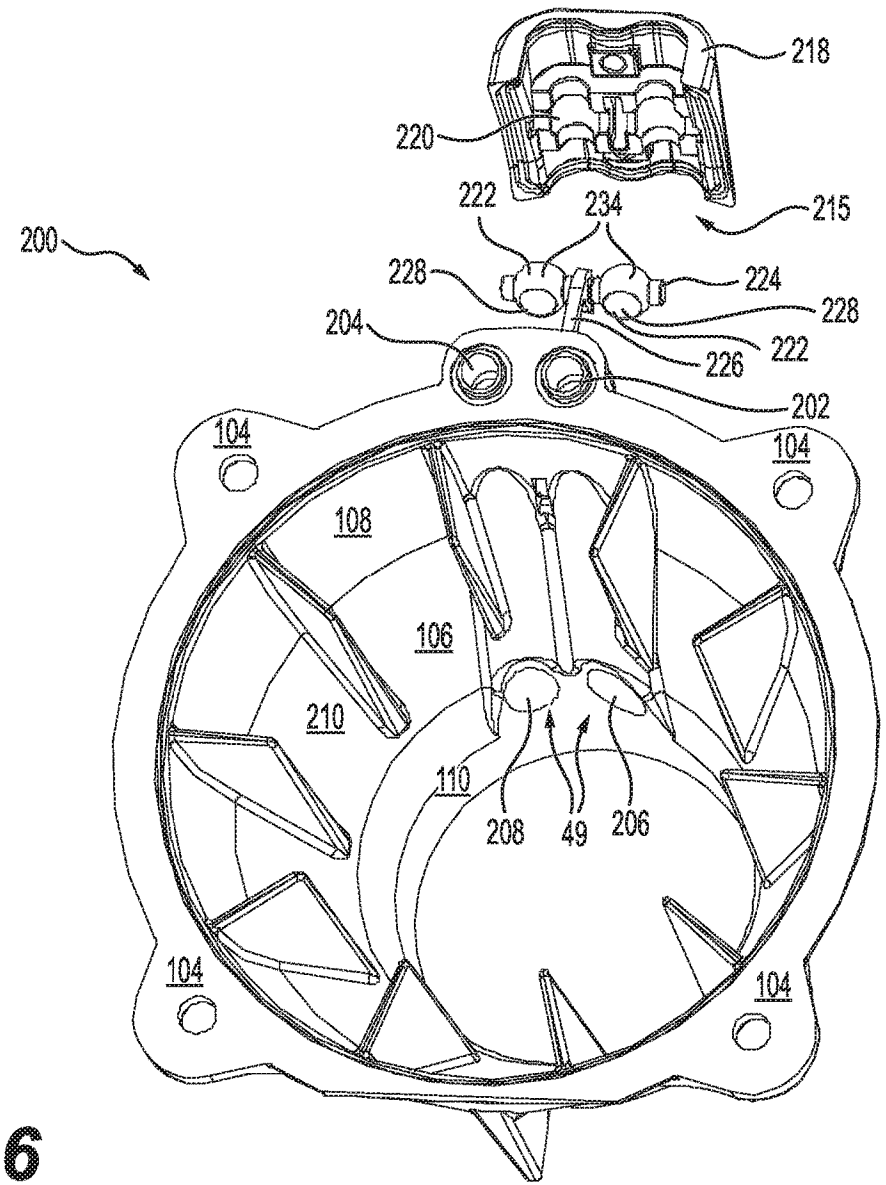
FIG. 16 is an exploded view, taken from a front, bottom, left side, of the venturi unit of FIG. 15.
Figure 17:
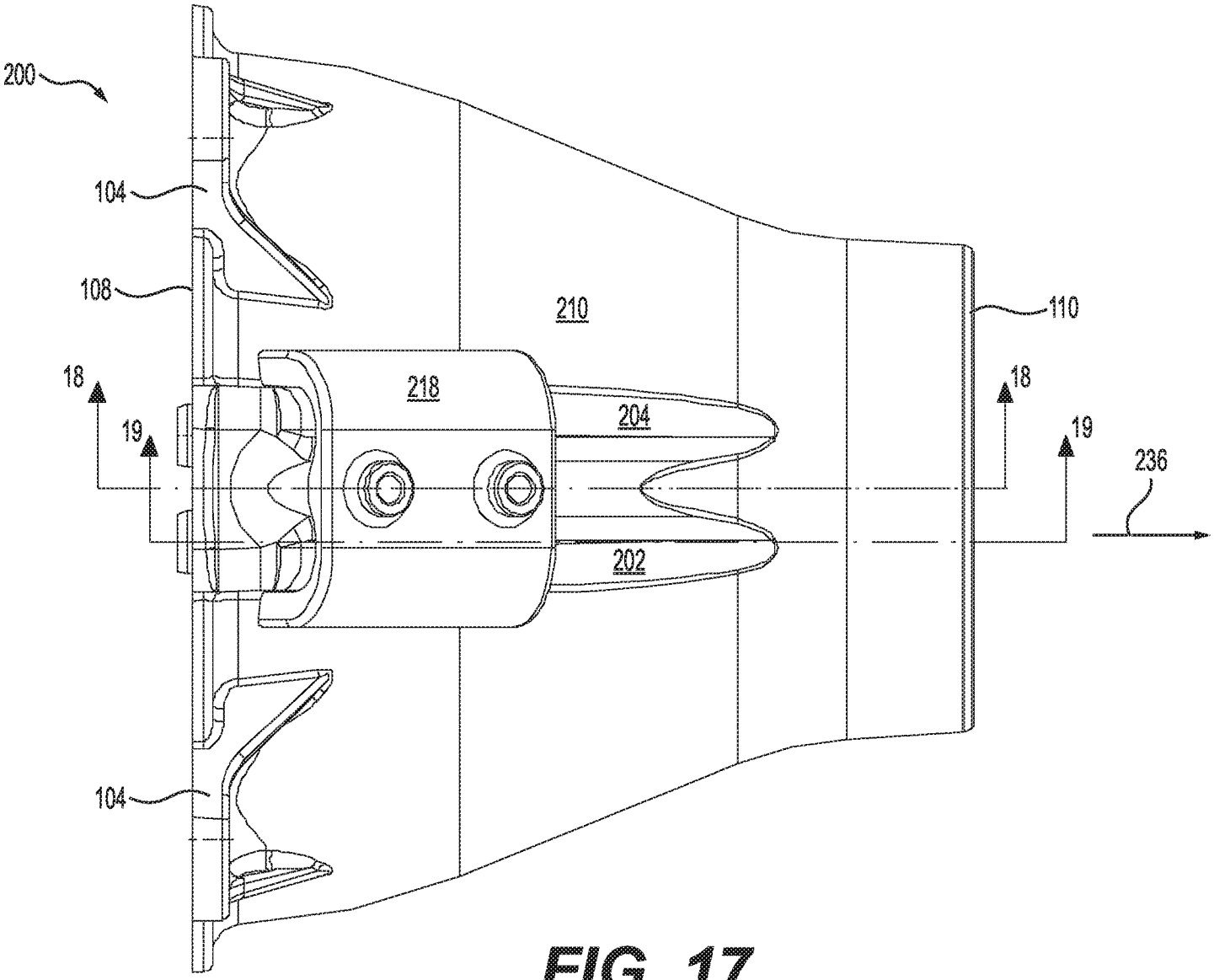
FIG. 17 is a top plan view of the venturi unit of FIG. 15.

The seat 215 is then closed by a top cap 218 bolted to the outer side of the peripheral wall 210 over the channels 202, 204. The top cap 218 defines a second, complementary, part 220 of the seat 215 as shown in FIG. 16. The second part 220 of the seat 215 mates with the first part 212 of the seat 215 and encloses the valve 216 in the seat 215. The top cap 218 thereby keeps the valve 216 in the seat 215 during operation.

As shown in FIG. 15, similar to the valve 136, the valve 216 includes two ball portions 222 joined by a cylindrical post 224. One difference between the valve 216 and the valve 136 is that the valve 216 does not have the tubes 150. Instead, the valve 216 includes an arm 226 that is connected to a mid-portion of the cylindrical post 224 generally orthogonally to the cylindrical post 224, to pivot together with the ball portions 222. The arm 226 is received through the aperture 214 in the peripheral wall 210 and extends into the venturi conduit 106 of the venturi unit 200. The ball portions 222 of the valve 216 are received in and operatively mate with respective portions of the seat 215. The ball portions 222 are thus disposed at least in part radially outward of the peripheral wall 210, and are outside of the venturi conduit 106.

Figure 18:
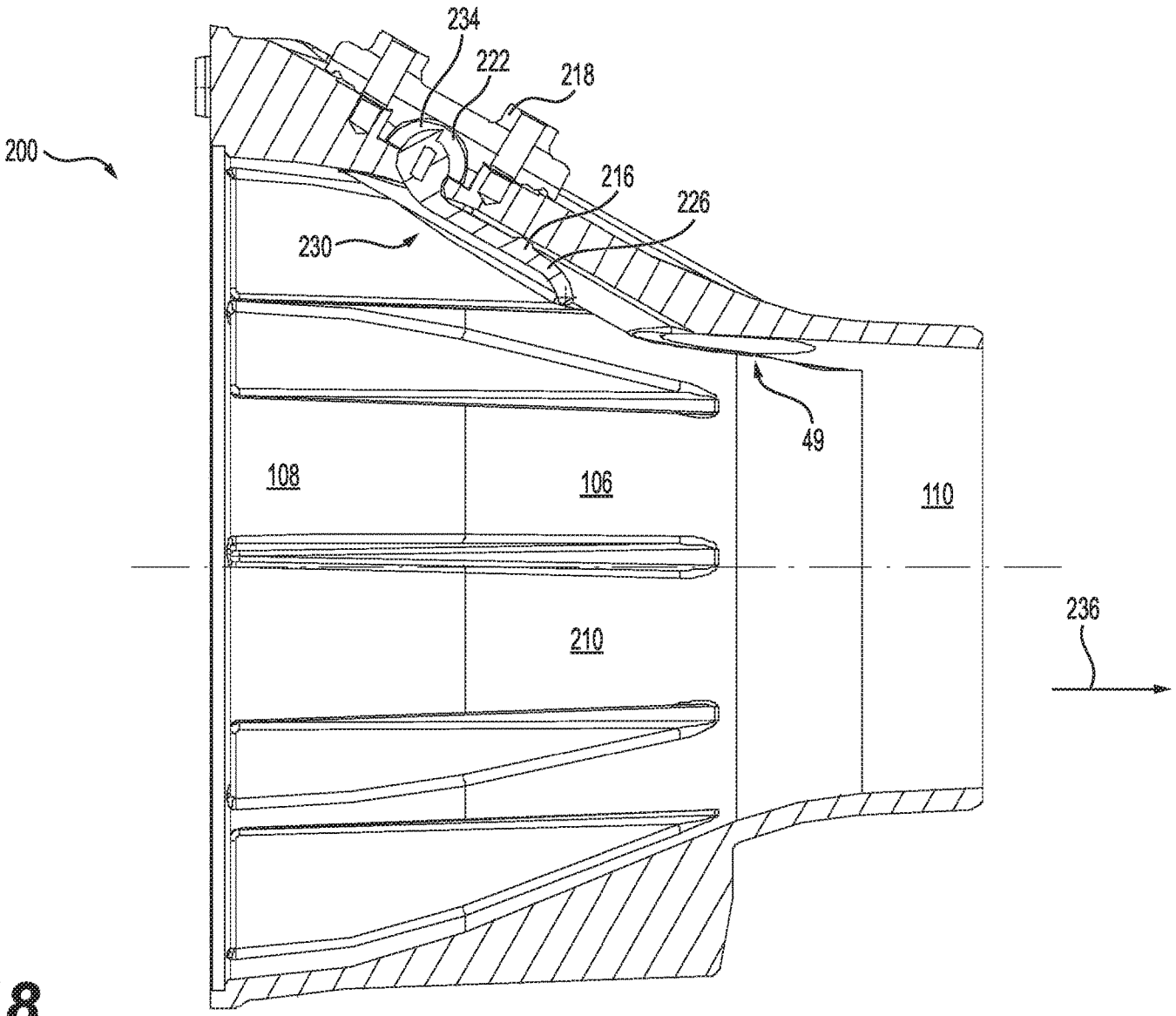
FIG. 18 is a cross-sectional view of the venturi unit of FIG. 15, taken along section line 18-18 in FIG. 17, with a valve of the venturi unit being in the open position.
Figure 19:
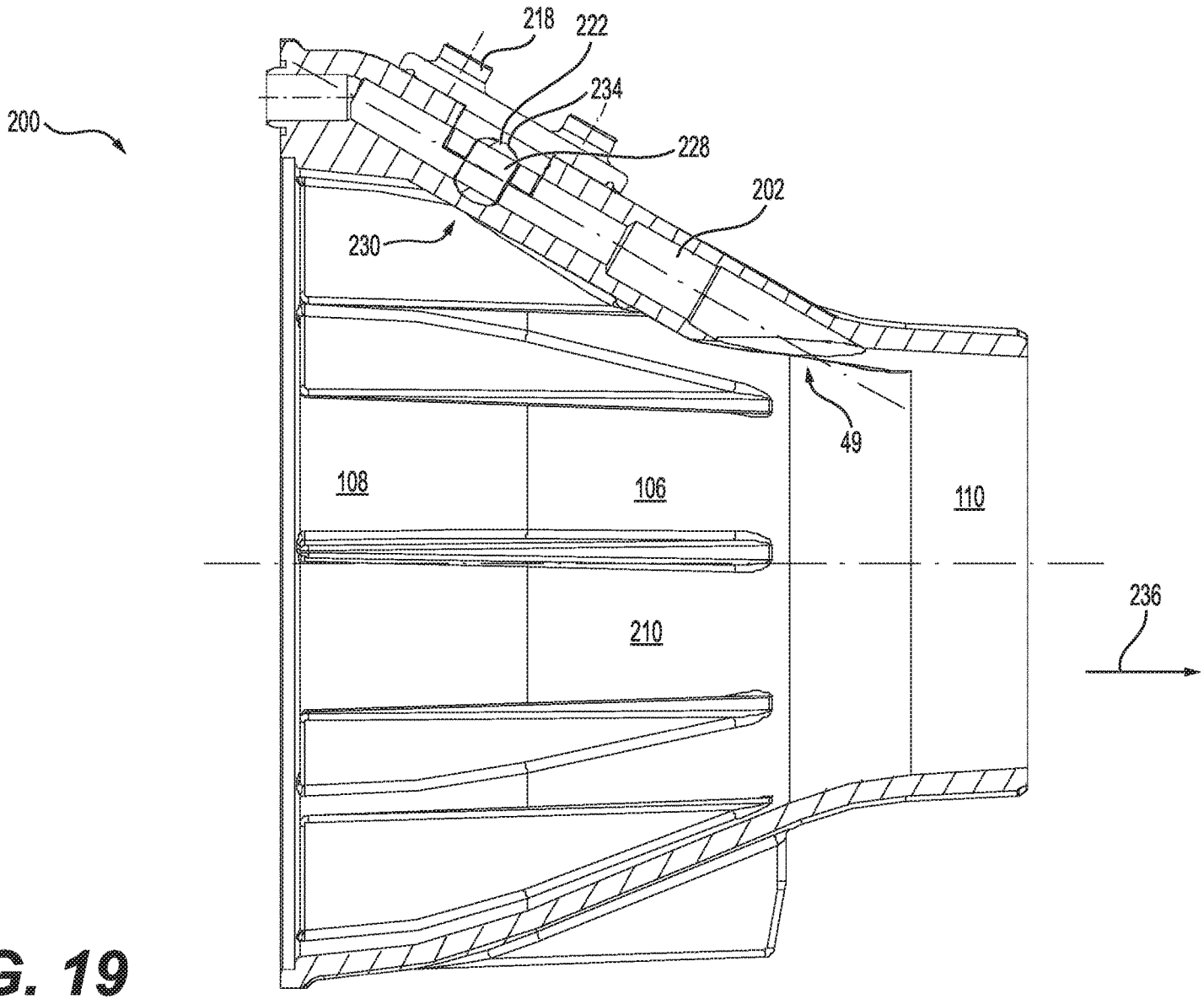
FIG. 19 is a cross-sectional view of the venturi unit of FIG. 15, taken along section line 19-19 in FIG. 17, with the valve of the venturi unit being in the open position.
Figure 20:
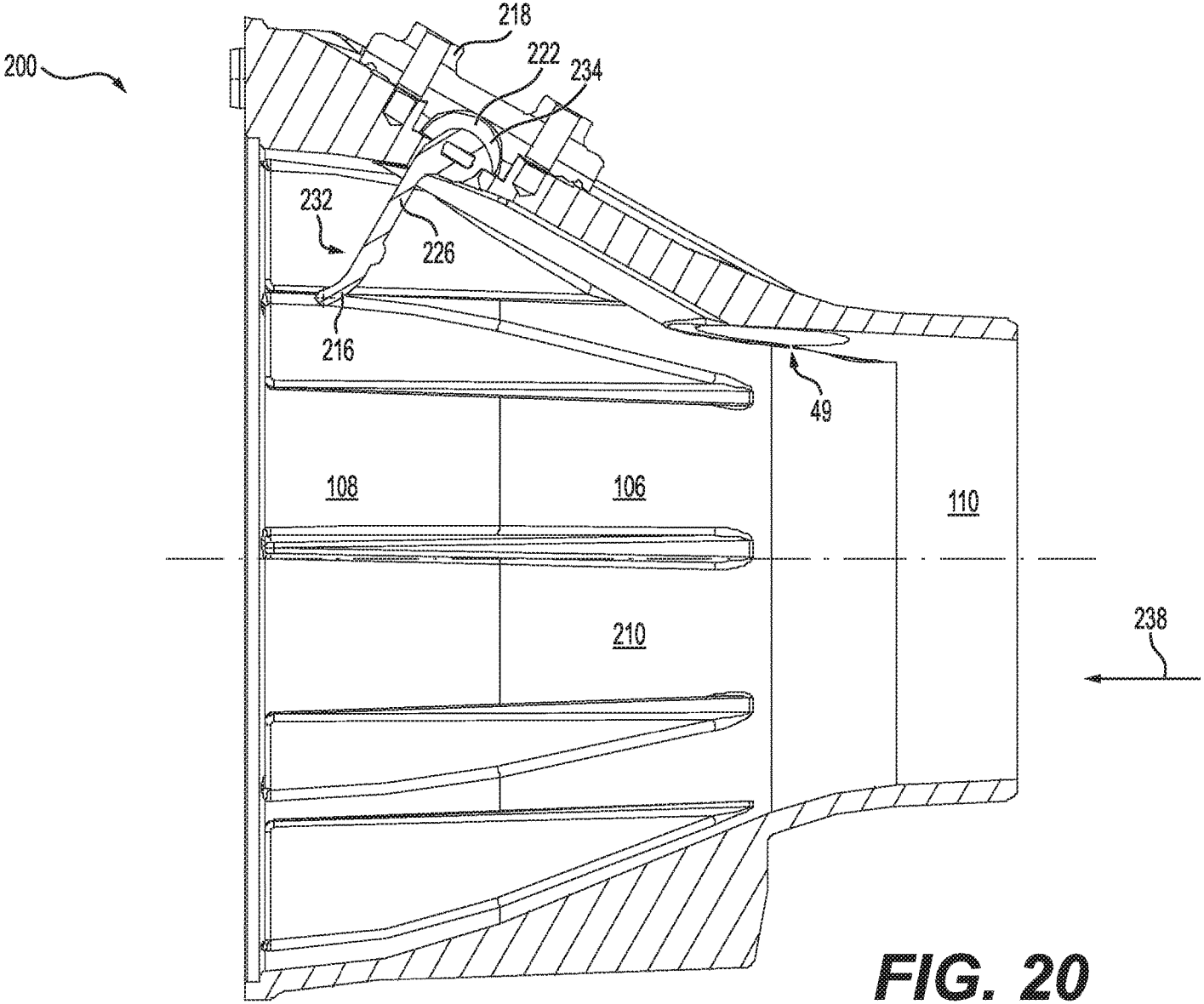
FIG. 20 is a cross-sectional view of the venturi unit of FIG. 15, taken along section line 18-18 in FIG. 17, with the valve of the venturi unit being in the closed position.
Figure 21:
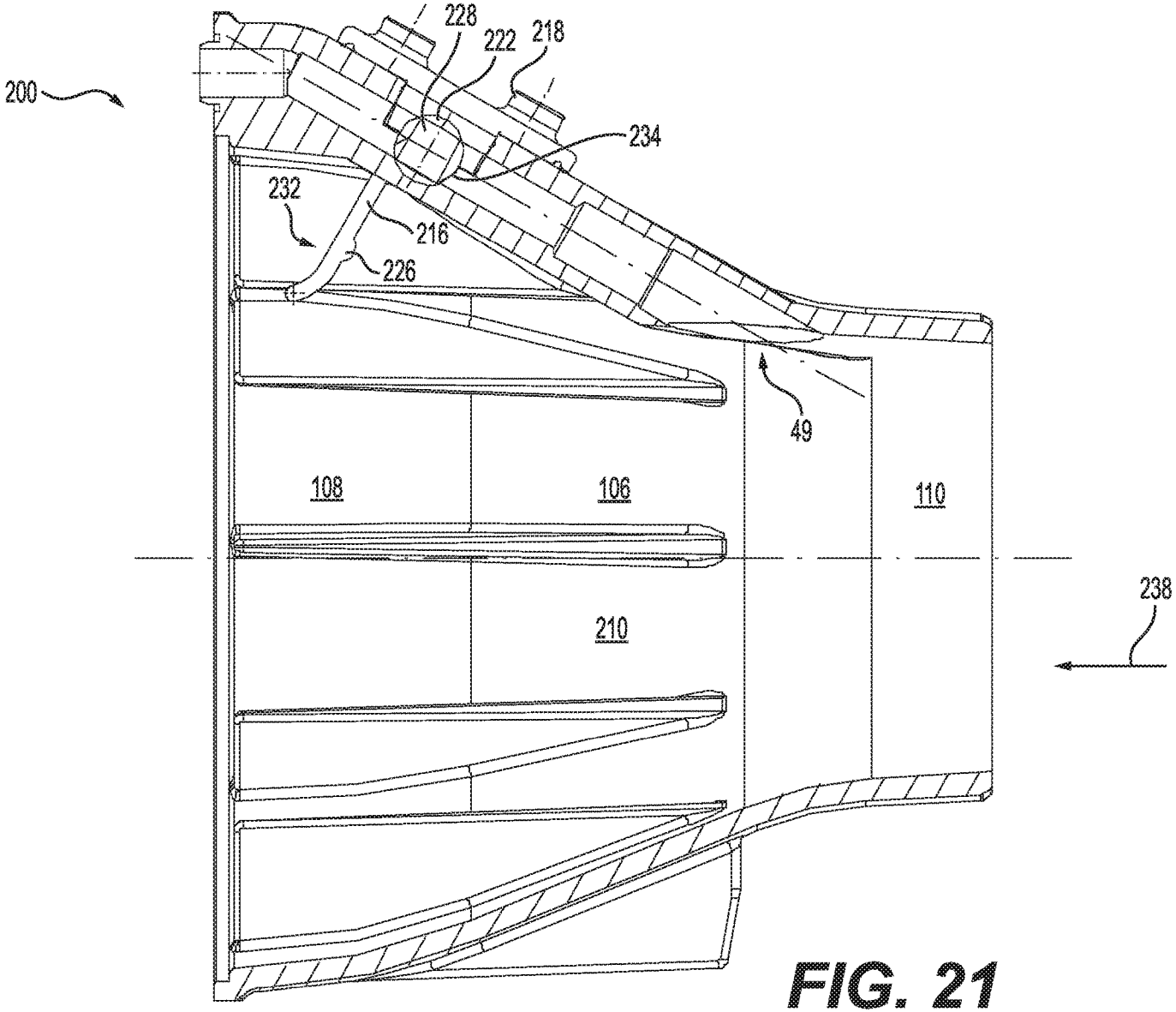
FIG. 21 is a cross-sectional view of the venturi unit of FIG. 15, taken along section line 19-19 in FIG. 17, with the valve of the venturi unit being in the closed position.
Figure 22:
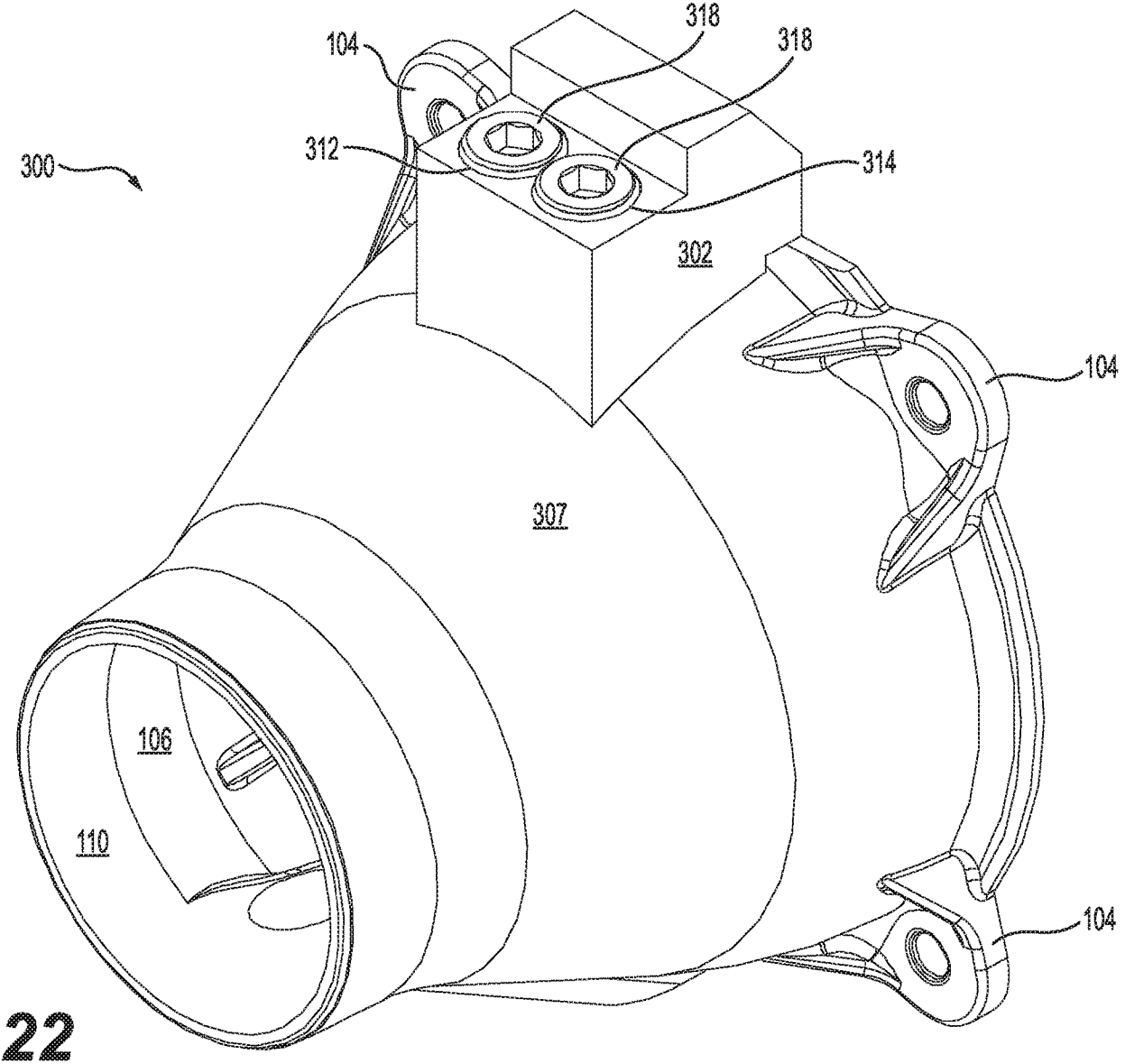
FIG. 22 is a perspective view, taken from a rear, right side, of a venturi unit of the jet propulsion system of FIG. 3, according to another embodiment.
Figure 23:
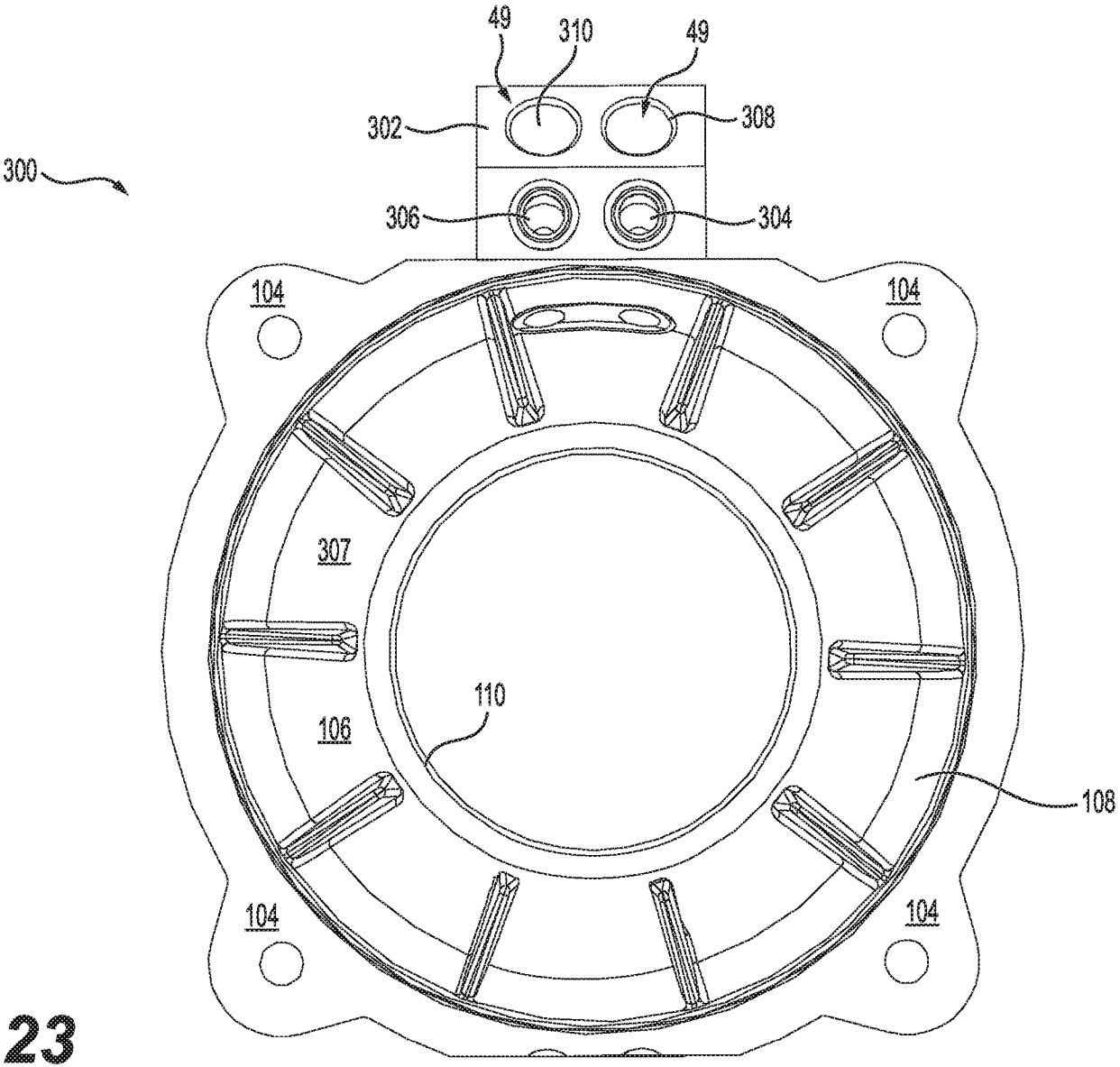
FIG. 23 is a front elevation view of the venturi unit of FIG. 22.

The ball portions 222 define apertures 228 therethrough. As shown in FIGS. 18 and 19, when the valve 216 is in the open position 230 the apertures 228 align with the respective ones of the channels 202, 204 and thereby fluidly connect the fluid outlets 49 of the bailer-siphon system 41 to the respective fluid inlets 45 of the bailer-siphon system 41. On the other hand, as shown in FIGS. 20 and 21, when the valve 216 is in the closed position 232, an outer surface 234 of each of the ball portions 222 blocks a respective one of the channels 202, 204 and thereby fluidly disconnects the fluid outlets 49 from the fluid inlets 45.

As shown in FIGS. 18 and 19, when the watercraft 10 is in use, a rearward flow 236 of water from the venturi inlet 108 toward the venturi outlet 110 acts on the arm 226 and pivots the arm 226 and thus the valve 216 from the closed position 232 to the open position 230. This allows the bailer-siphon system 41 to draw water and/or air out of the motor compartment 20. As shown in FIGS. 20 and 21, when the watercraft 10 is in use, a forward flow 238 of water from the venturi outlet 110 toward the venturi inlet 108 acts on the arm 226 and pivots the arm 226 and thus the valve 216 from the open position 230 to the closed position 232. This fluidly disconnects the fluid outlets 49 of the bailer-siphon system 41 from the fluid inlets 45 of the bailer-siphon system 41, and prevents aeration of the impeller 72 via the bailer-siphon system 41. As seen here, the arm 226 is one example of an element that can be used to harvest energy from flows of water through the venturi conduit 106 in order to operate the valve 216 between the closed position 232 and the open position 230. It is contemplated that a different element could be used.

Reference is now made to FIGS. 22 to 26, which show a venturi unit 300. The venturi unit 300 is another alternative embodiment of the venturi unit 100. Parts of the venturi unit 300 that are similar to corresponding parts of the venturi unit 100 have been labeled with the same corresponding reference numerals and will not be described again in detail.

One difference between the venturi unit 300 and the venturi unit 100 is that the venturi unit 300 includes a ball valve 302 operated by water pressure in the venturi unit 300.

Figure 24:
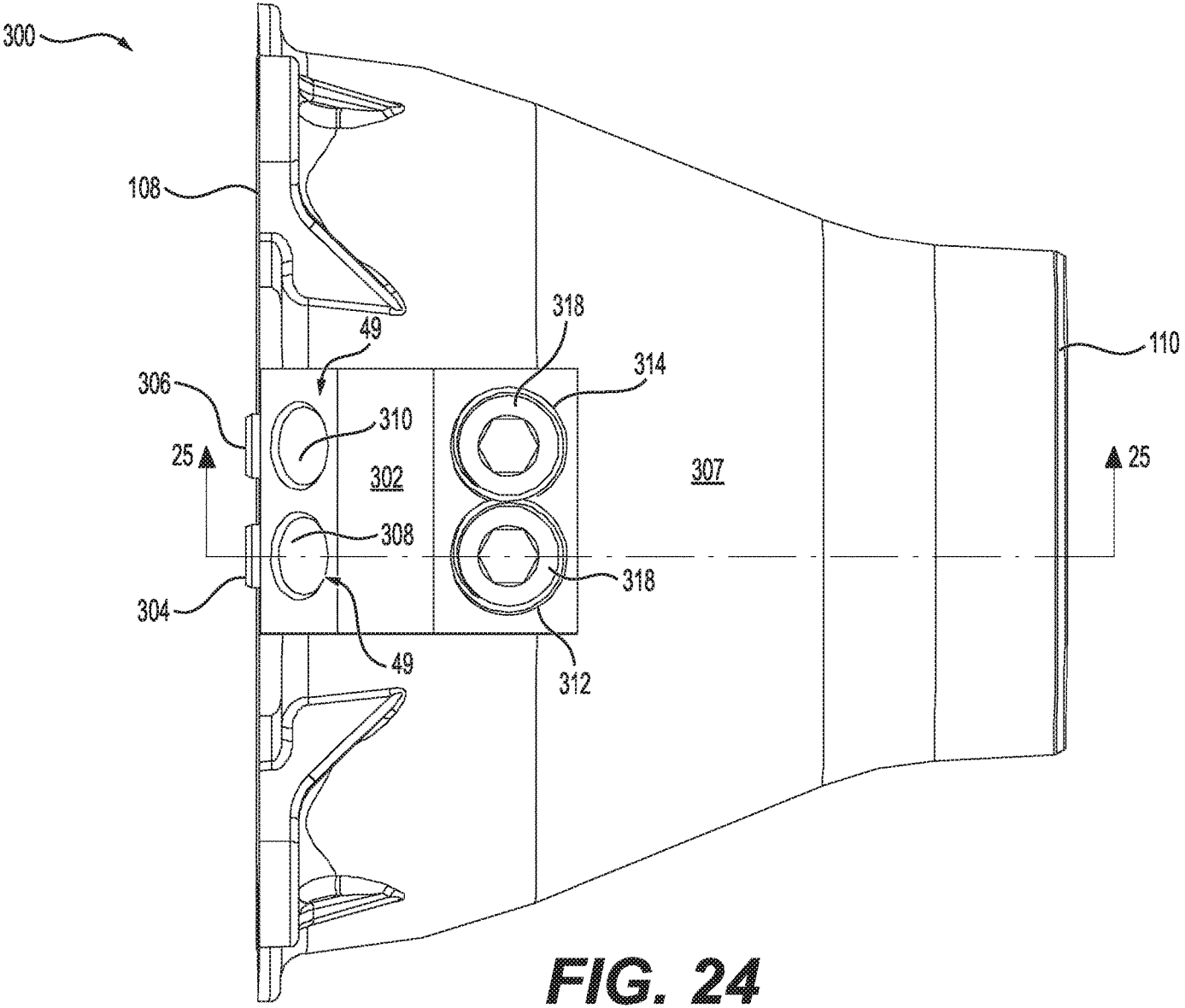
FIG. 24 is a top plan view of the venturi unit of FIG. 22.
Figure 25:
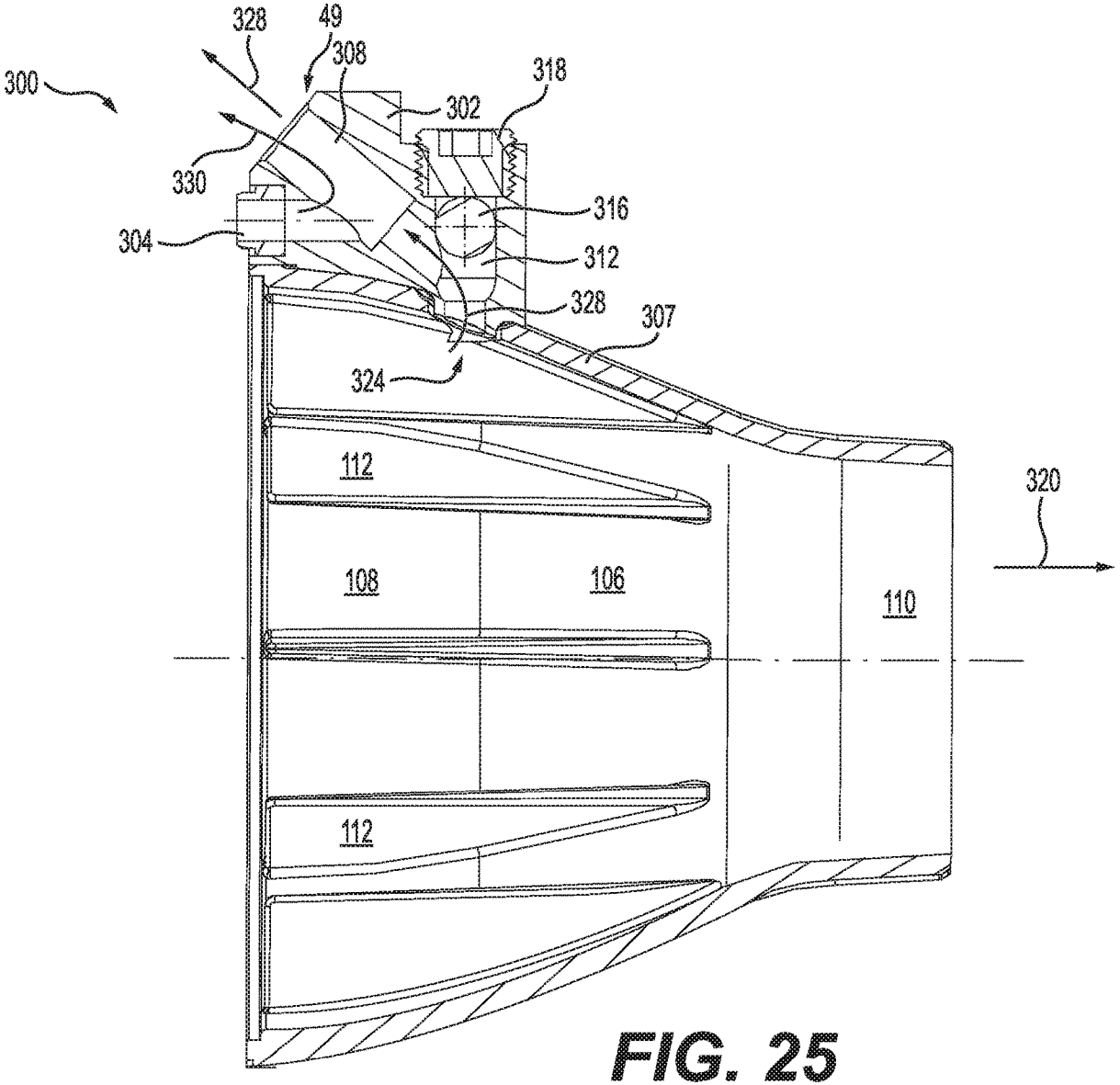
FIG. 25 is a cross-sectional view of the venturi unit of FIG. 22, taken along section line 25-25 in FIG. 24, with the valve of the venturi unit being in the open position.
Figure 26:
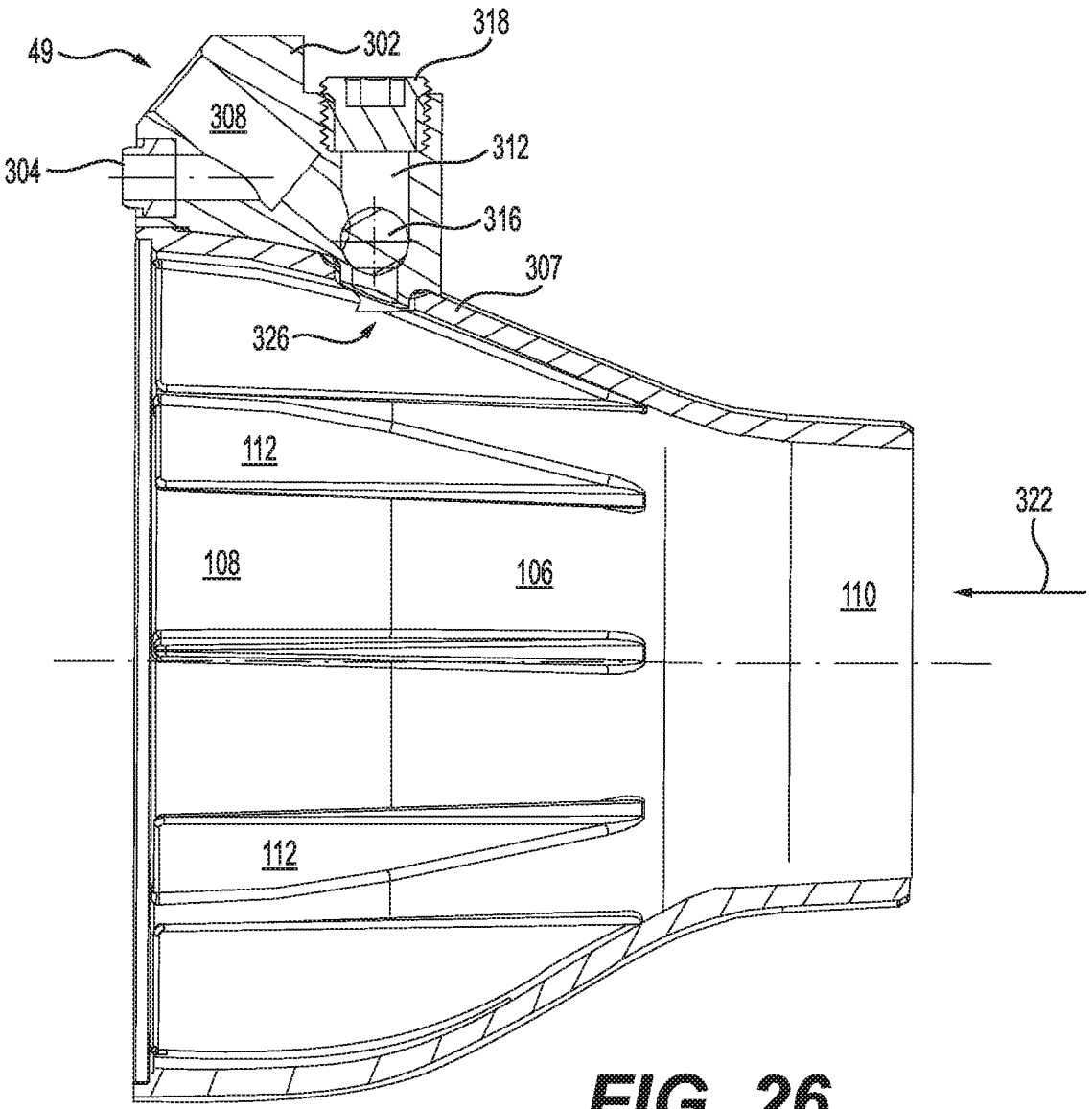
FIG. 26 is a cross-sectional view of the venturi unit of FIG. 22, taken along section line 25-25 in FIG. 24, with the valve of the venturi unit being in the closed position.

Referring to FIGS. 23 to 26, the valve 302 defines a pair of channels 304, 306 that at their front ends fluidly connect to respective ones of the tubes 124, 126 of the impeller housing 70. As shown in FIGS. 25 and 26, the channels 304, 306 at their respective rear ends fluidly connect to respective ones of a pair of angled channels 308, 310, also defined by the valve 302. The angled channels 308, 310 are open at their front ends and define the fluid outlets 49 of the bailer-siphon system 41. As shown in FIGS. 25 and 26, in this embodiment the fluid outlets 49 are disposed outside of the venturi conduit 106.

Also as shown in FIGS. 25 and 26, the angled channels 308, 310 are larger in diameter than the respective ones of the channels 304, 306 at the point of where the angled channels 308, 310 fluidly connect to the respective ones of channels 304, 306. The larger diameter serves to create a lower pressure zone during operation of the impeller 72 in the forward direction, as explained below.

As shown in FIGS. 24 to 26, the valve 302 yet further defines a pair of vertical channels 312, 314 (FIG. 24) that fluidly connect to respective ones of the angled channels 308, 310. The vertical channels 312, 314 at their bottom ends traverse the peripheral wall 307 of the venturi unit 300 into the venturi conduit 106 and open in a direction substantially locally perpendicular to the flow of water through the venturi conduit 106. Referring to FIGS. 25 and 26, each of the vertical channels 312, 314 receives a ball 316 therein and is enclosed at a top end thereof by a cap 318. The caps 318 are threaded into corresponding threads defined in the top ends of the vertical channels 312, 314 and keep the balls 316 from exiting the vertical channels 312, 314 in an upward direction. The vertical channels 312, 314 at their bottom ends are tapered to diameters that are smaller than the respective ones of the balls 316. These smaller diameters keep the balls 316 from exiting the vertical channels 312, 314 in an downward direction.

Similarly, the angled channels 308, 310 at their rear ends have diameters that are smaller than the respective ones of the balls 316. The smaller diameters of the angled channels 308, 310 keep the balls 316 from exiting the vertical channels 312, 314 via the angled channels 308, 310. The balls 316 are solid and do not define apertures therethrough.

As shown in FIG. 25, when the watercraft 10 is in use, a rearward flow 320 of water from the venturi inlet 108 toward the venturi outlet 110 pushes the balls 316 upwards away from the peripheral wall 307 toward the respective ones of the caps 318. This fluidly connects the channels 304, 306, 308, 310 to the venturi conduit 106 and places the valve 302 in its open position 324. In the open position 324, some of the rearward flow 320 exits the venturi conduit 106 via the vertical channels 312, 314 and then the angled channels 308, 310 (fluid outlets 49), as shown with arrows 328 in FIG. 25.

In this flow condition, the larger diameters of the angled channels 308, 310 at the point where the angled channels 308, 310 fluidly connect to the respective ones of the channels 304, 306 create a low pressure zone that draws water and/or air from the motor compartment 20 via the fluid inlets 45 of the bailer-siphon system 41. The flow of water and/or air from the fluid inlets 45 is shown with arrow 330 in FIG. 25. As shown, the flow 330 mixes with the flow 328 and exits via the fluid outlets 49 of the bailer-siphon system 41.

As shown in FIG. 26, when the watercraft 10 is in use, a forward flow 322 of water from the venturi outlet 110 toward the venturi inlet 108 pulls the balls 316 downwards toward the peripheral wall 307 and into the respective ones of the tapered bottom ends of the vertical channels 312, 314. The balls 316 thereby mate with and fluidly block the tapered bottom ends of the vertical channels 312, 314. This fluidly disconnects the channels 304, 306, 308, 310 from the venturi conduit 106 and places the valve 302 in its closed position 326. The valve 302 thereby prevents water or air from entering the forward flow 322 in the venturi conduit 106 via any of the channels 304, 306, 308, 310, and thus prevents aeration of the impeller 72 via the bailer-siphon system 41.

It is contemplated that the orientations of the channels 304, 306, 308, 310, 312 and 314 could be different than as shown, for example that the channels 308, 310 could be oriented to open rearward instead upward and forward. It is contemplated that, rather than being passively operated by the flow and/or pressure of water within the venturi conduit 106, in alternative embodiments the valves 136, 216, 302 could be actively operated by an actuator. For instance, in such embodiments, the actuator could be a step motor that selectively pivots the valves 136, 216, 302 between the open position and the closed position. In other embodiments, the actuator could be a mechanical system operated by the operator of the watercraft 10.

In the present embodiment, the valves 136, 216, 302 are provided at the respective venturi units 100, 200, 300. It is contemplated that the valves 136, 216, 302 could be remote from the venturi units 100, 200, 300, in both passively- and actively-actuated valve embodiments. It is also contemplated that fluid conduit 43 of the bailer-siphon system 41 could be defined by a different number of hoses, tubes, valves and/or other elements.

It is further contemplated that the valves 136 and 216 could have a different number of ball portions 146, 222 and corresponding channels, including a single ball portion and a single channel. It is further contemplated that the valve 302 could have a different number of corresponding channels 304, 306, 308, 310, 312, 314 and balls 316.

Moreover, it is contemplated that the venturi unit 100 could be provided separately as an after-market accessory for replacing a conventional venturi unit.

Reference is now made to FIGS. 27 to 31, which show a jet propulsion system. The jet propulsion system 400 is an alternative embodiment of the jet propulsion system 50. Parts of the jet propulsion system 400 that are similar to corresponding parts of the jet propulsion system 50 have been labeled with the same corresponding reference numerals and will not be described again in detail.

The hoses 116 (reference being made to the embodiment of FIG. 3) extending between the siphon breaks 118 and the impeller housing 70 are fluidly connected at their respective rear ends to tubes 402 that are defined by a peripheral wall 128 of the impeller housing 70. In turn, at their rear ends the tubes 402 are fluidly connected to tubes 404 defined by a peripheral wall 134 of the venturi unit 406. Tubular extensions 408 are received in the tubes 404 and extend into the passage defined by the venturi unit 406. The tubular extensions 408 define the fluid outlets 49 of the bailer-siphon system.

A valve 410 is provided in the tubes 402. In this embodiment, the valve 410 is a ball valve 410 that includes two ball portions 412 (only one of which is shown) joined by a cylindrical post (not shown, but similar to the valve 136 without the tubes 150). Each ball portion 412 is received in a corresponding seat 414 defined by the tubes 402. The ball portions 412 define apertures 416 therethrough. In alternative embodiments, the valve 410 is provided in the tubes 402 and/or the tubular extensions 408. It is contemplated that the valve 410 could be another type of valve, such as a guillotine valve or a butterfly valve for example.

Figure 28:
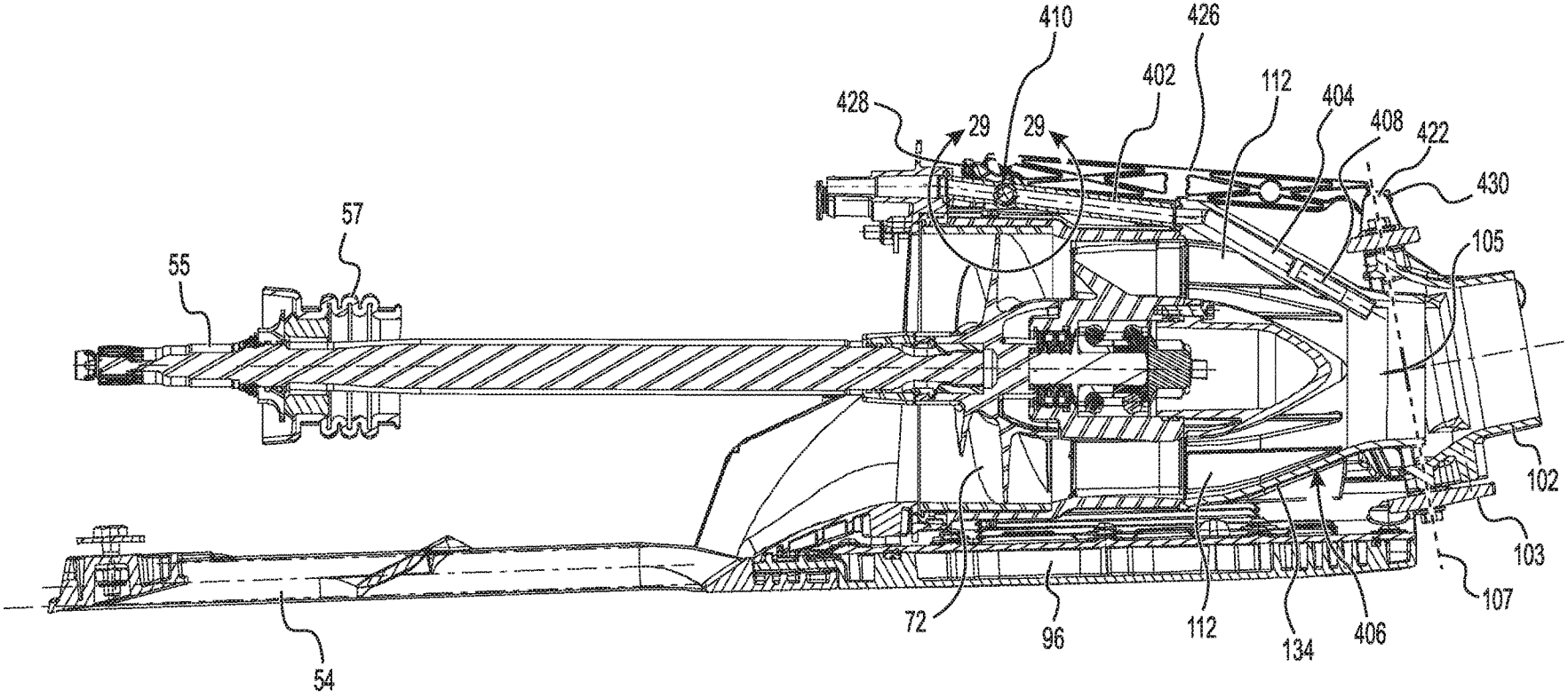
FIG. 28 is a longitudinal cross-section of components of the jet propulsion system of FIG. 27, with a steering nozzle in a trim-up position and a valve on the impeller housing in a partially open position.
Figure 29:
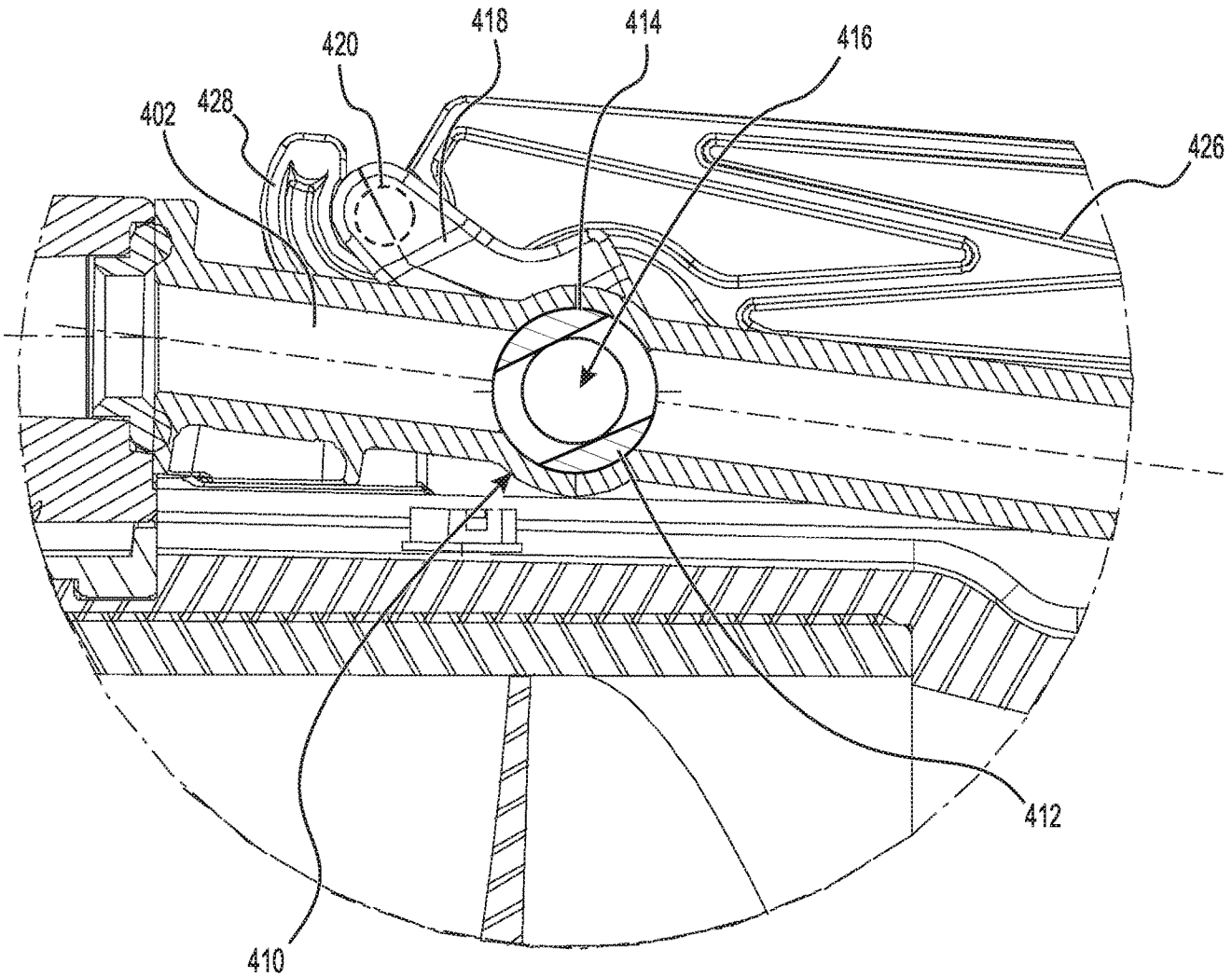
FIG. 29 is a close-up view of portion 29-29 of FIG. 28.
Figure 30:
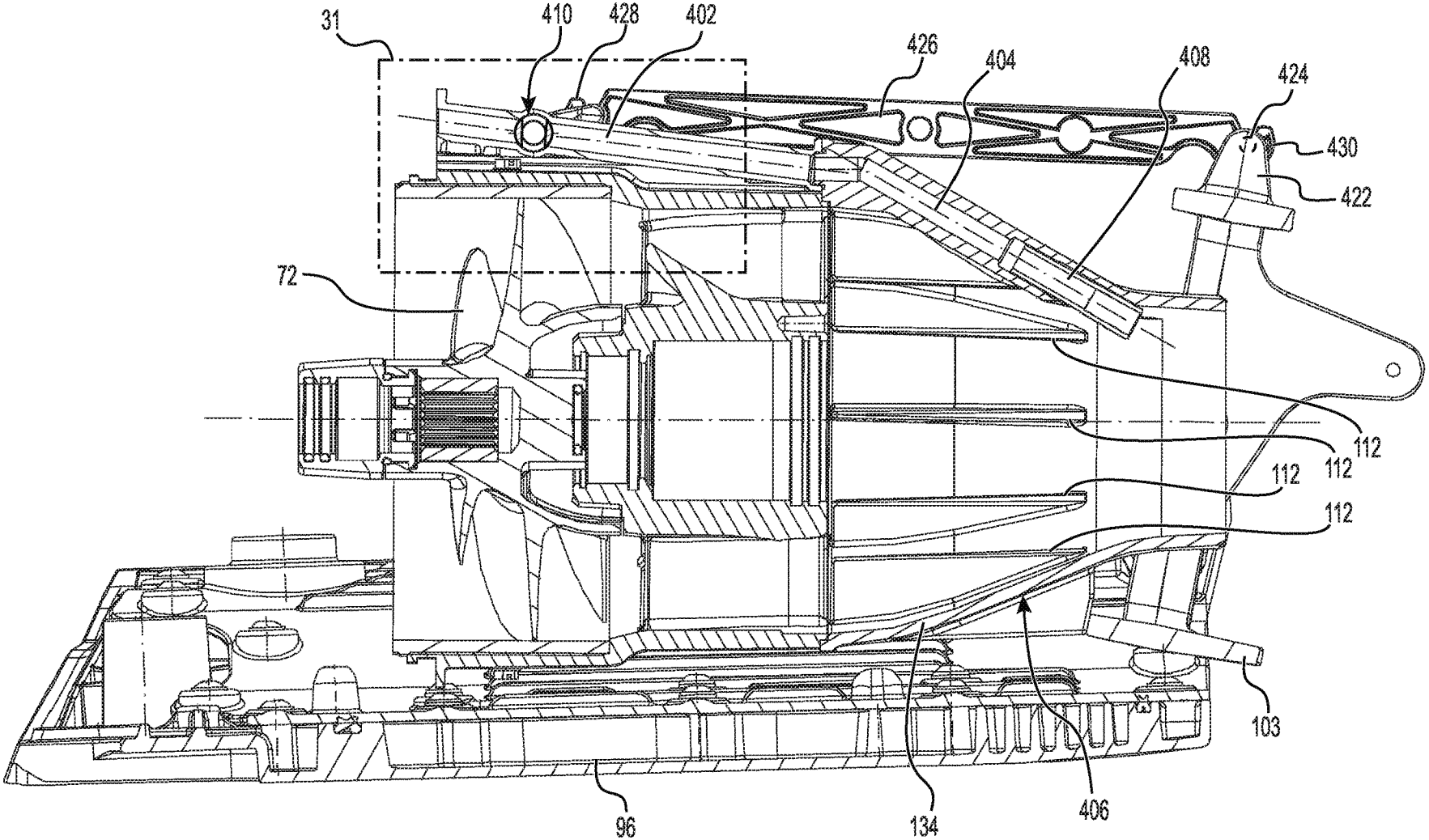
FIG. 30 is a longitudinal cross-section of components of the jet propulsion system of FIG. 27, with the steering nozzle in a trim-down position and the valve on the impeller housing in a closed position.
Figure 31:
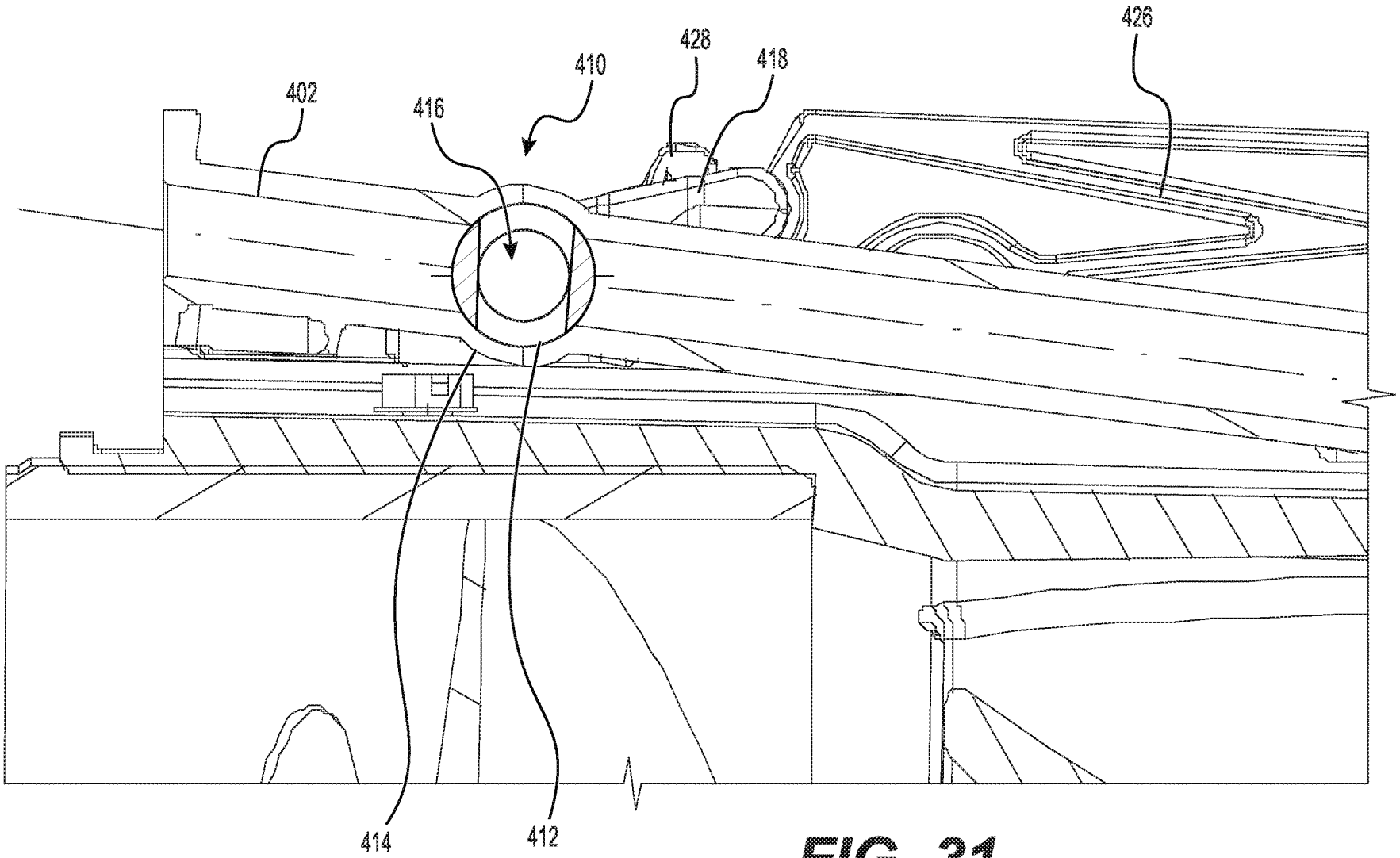
FIG. 31 is a close-up view of portion 31 of FIG. 30.

The valve 410 is pivotable between open positions (FIGS. 28, 29) and a closed position (FIGS. 30, 31). It should be understood that when the valve 410 is partially opened as shown in FIGS. 28, 29, this is still considered an open position for purposes of the present application. When the valve 410 is in an open position, the apertures 416 of the ball portions 412 fluidly connect with the tubes 402, as shown in FIGS. 28, 29, and thereby fluidly connect the fluid outlets 49 of the bailer-siphon system to the respective fluid inlets of the bailer-siphon system. In the closed position, as shown in FIGS. 30, 313, an outer surface of each of the ball portions 412 blocks a respective one of the tubes 402 and thereby fluidly disconnects the fluid outlets 49 from the fluid inlets of the bailer-siphon system. When the valve 410 is in an open position, the impeller 72 can be rotated in the forward direction. When the valve 410 is in the closed position, the impeller 72 can be rotated in the forward or the reverse direction.

Figure 27:
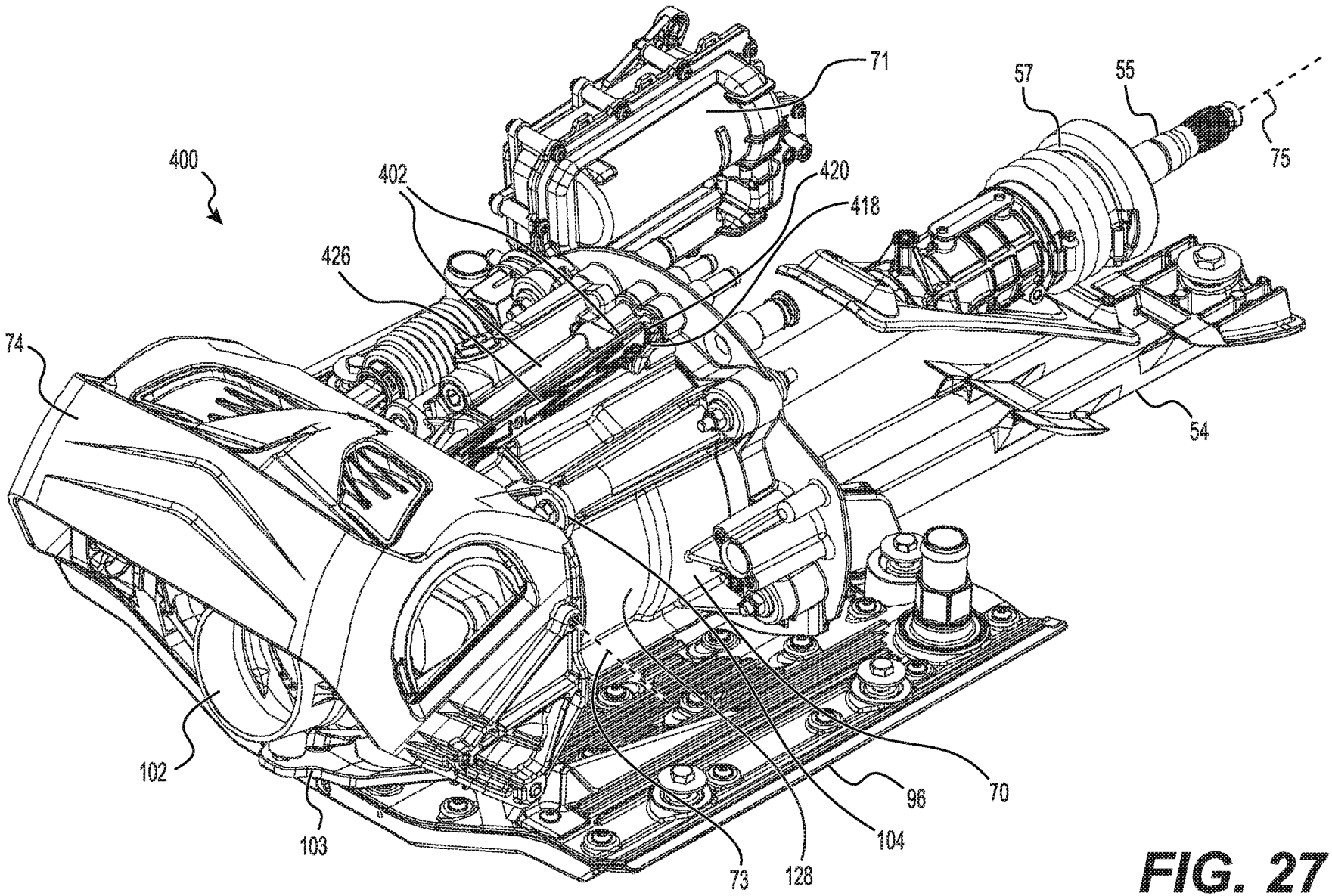
FIG. 27 is a perspective view, taken from a rear, right side, of an alternative embodiment of the jet propulsion system of FIG. 4.

The valve 410 has a pair of arms 418 between which a shaft 420 extends (see FIG. 27). The arms 418 are connected to the ball portions 412 and rotate therewith. The VTS support 103 has an arm 422 at a top thereof from which a shaft 424 extends (see FIG. 30). A link 426 is connected between the shaft 420 and the shaft 424. More specifically, the link 426 has a hook 428 at a front thereof that is received between the arms 418 and pivotally engages the shaft 420 and a hook 430 at a rear thereof that pivotally engages the shaft 424. As such, pivoting the VTS support 103 about the VTS axis 105 causes the link 426 to push or pull on the shaft 420 to open and close the valve 410 by rotating the ball portions 412. When the VTS support 103, and therefore the steering nozzle 102, is in the maximum trim-down position, as shown in FIG. 30, the valve 410 is closed. When the VTS support 103, and therefore the steering nozzle 102, is in a trim-up position, in a neutral axis (i.e. the central axis of the steering nozzle being aligned with the axis 75), and in trim-down positions intermediate the neutral and maximum trim-down positions, the valve 410 is at least partially open. It is contemplated that the valve 410 could be closed at a different position than the one described above, such as a maximum trim-up position for example.

It is contemplated that in alternative embodiments, the link 426 could be connected directly to the steering nozzle 102 or to the reverse gate 74. When the link 426 is connected to the reverse gate 74, the valve 410 is closed when the reverse gate 74 is at a predetermined position, such as a fully lowered position or a position intermediate the stowed and fully lowered positions, and the valve 410 is opened when the reverse gate 74 is in the stowed position and in positions intermediate the stowed position and the predetermined position.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a hull having a bow and a stern opposite the bow, the hull defining at least a part of a motor compartment;

a motor supported by the hull and disposed within the motor compartment;

a jet propulsion system comprising:

a duct defining a water inlet in a bottom of the hull;

a venturi unit defining part of the duct and defining a venturi outlet;

an impeller housing defining part of the duct and disposed between the inlet and the venturi unit; and an impeller disposed within the impeller housing, the impeller being operatively connected to the motor, the impeller being rotatable about an impeller rotation axis in (i) a forward direction whereby the impeller propels water from the water inlet rearward and out of the venturi outlet, and (ii) a reverse direction whereby the impeller propels water from the venturi outlet forward and out of the water inlet; and a bailer-siphon system comprising a fluid conduit, the fluid conduit being defined in part by a valve, the fluid conduit having:

a fluid inlet disposed inside the motor compartment for drawing water out of the motor compartment; and a fluid outlet in fluid communication with the venturi outlet at least when the impeller rotates in the forward direction while the watercraft is in use, the valve being operable between an open position in which the valve fluidly connects the fluid inlet to the fluid outlet, and a closed position in which the valve fluidly disconnects the fluid inlet from the fluid outlet, the valve being in the open position when the impeller rotates in the forward direction while the watercraft is in use thereby allowing flow of water through the venturi outlet to move water out of the motor compartment, the water entering the fluid inlet of the fluid conduit and exiting the fluid outlet of the fluid conduit, and the valve being in the closed position when the impeller rotates in the reverse direction while the watercraft is in use.

2. The watercraft of claim 1, wherein:

the valve is moved to the open position when the impeller rotates in the forward direction while the watercraft is in use; and the valve is moved to the closed position when the impeller rotates in the reverse direction while the watercraft is in use.

3. The watercraft of claim 1, wherein the valve is disposed at the venturi unit.

4. The watercraft of claim 2, wherein the valve is operated between the open position and the closed position by a direction of flow of water through the duct.

5. The watercraft of claim 2, wherein the valve includes an element pivotable about a pivot axis by flow of water generated by the impeller to operate the valve between the open position and the closed position.

6. The watercraft of claim 4, wherein:

the venturi unit includes a peripheral wall;

the fluid outlet is disposed radially outward of the peripheral wall;

the valve fluidly connects the fluid outlet to the venturi outlet via a passage through the peripheral wall when the impeller rotates in the forward direction; and the valve fluidly disconnects the fluid outlet from the venturi outlet when the impeller rotates in the reverse direction.

7. The watercraft of claim 6, wherein:

the valve includes a ball;

the ball is pushed away from an inner side of the peripheral wall by flow of water through the duct generated by the impeller rotating in the forward direction to fluidly connect the fluid outlet to the venturi outlet via the inner side of the peripheral wall; and the ball is pulled toward the inner side of the peripheral wall by flow of water through the duct generated by the impeller rotating in the reverse direction to fluidly disconnect the fluid outlet from the venturi outlet at the inner side of the peripheral wall.

8. The watercraft of claim 1, wherein:

the jet propulsion system further comprises at least one of:

a steering nozzle pivotable about a steering axis and about a variable trim system (VTS) axis relative to the venturi; and a reverse gate movable between a stowed position and a fully lowered position;

the valve is operatively connected to one of the at least one of the steering nozzle and the reverse gate such that:

when the at least one of the steering nozzle and the reverse gate is the steering nozzle, the valve is moved between the open and closed positions by rotation of the steering nozzle about the VTS axis; and when the at least one of the steering nozzle and the reverse gate is the reverse gate, the valve is moved by movement of the reverse gate such that the valve is moved to the closed position when the reverse gate is moved to a predetermined position, the predetermined position being the fully lowered position or a position intermediate the stowed position and the fully lowered position.

9. The watercraft of claim 8, wherein at least one of the steering nozzle and the reverse gate includes the steering nozzle and the valve is operatively connected to the steering nozzle.

10. The watercraft of claim 9, wherein:

the steering nozzle is pivotable about the VTS axis between a plurality of trim-up positions and a plurality of trim-down positions;

the valve is moved to the closed position when the steering nozzle is pivoted to a predetermined trim-down position of the plurality of trim-down positions; and the valve is at least partially open at positions other than the predetermined trim-down position.

11. The watercraft of claim 10, further comprising a VTS support pivotable about the VTS axis;

wherein:

the steering nozzle pivots with the VTS support about the VTS axis;

the steering nozzle pivots about the steering axis relative to the VTS support; and the valve is operatively connected to the VTS support.

12. The watercraft of claim 11, further comprising a link operatively connecting the valve to the VTS support, the link being pivotally connected to the valve, and the link being pivotally connected to the VTS support.

13. The watercraft of claim 8, wherein the valve is a ball valve.

14. A venturi unit for a jet propulsion system of a watercraft, the venturi unit comprising:

a venturi conduit having a peripheral wall that defines a venturi inlet and a venturi outlet, the venturi inlet having a greater cross-sectional area than the venturi outlet; and a valve operable between an open position and a closed position and defining a part of a fluid conduit, the fluid conduit having:

a fluid inlet fluidly adapted for connection to a bailer-siphon system; and a fluid outlet in fluid communication with the venturi outlet, the valve being in the open position during flow of water through the venturi conduit from the venturi inlet to the venturi outlet, the valve being in the closed position during flow of water through the venturi conduit from the venturi outlet to the venturi inlet, in the open position, the valve fluidly connecting the fluid inlet to the fluid outlet, and in the closed position, the valve fluidly disconnecting the fluid inlet from the fluid outlet.

15. The venturi unit of claim 14, wherein the valve is operated:

to the open position by flow of water through the venturi conduit from the venturi inlet to the venturi outlet, and to the closed position by flow of water through the venturi conduit from the venturi outlet to the venturi inlet.

16. The venturi unit of claim 15, wherein the valve includes an element pivotable about a pivot axis by flow of water through the venturi conduit to operate the valve between the open position and the closed position, the element including a ball portion pivotable about the pivot axis, the ball portion defining an aperture through the ball portion, the aperture defining part of the fluid conduit when the valve is in the open position, an outer surface of the ball portion blocking the fluid conduit when the valve is in the closed position.

17. A watercraft comprising:

a hull having a bow and a stern opposite the bow, the hull defining at least a part of a motor compartment;

a motor supported by the hull and disposed within the motor compartment;

a jet propulsion system comprising:

a duct defining a water inlet in a bottom of the hull;

a venturi unit defining part of the duct and defining a venturi outlet;

at least one of:

a steering nozzle pivotable about a steering axis and about a variable trim system (VTS) axis relative to the venturi; and a reverse gate movable between a stowed position and a fully lowered position;

an impeller housing defining part of the duct and disposed between the inlet and the venturi unit; and an impeller disposed within the impeller housing, the impeller being operatively connected to the motor, and a bailer-siphon system comprising a fluid conduit, the fluid conduit being defined in part by a valve, the fluid conduit having:

a fluid inlet disposed inside the motor compartment for drawing water out of the motor compartment; and a fluid outlet in fluid communication with the venturi outlet, the valve being operable between an open position in which the valve fluidly connects the fluid inlet to the fluid outlet, and a closed position in which the valve fluidly disconnects the fluid inlet from the fluid outlet, the valve is operatively connected to one of the at least one of the steering nozzle and the reverse gate such that:

when the at least one of the steering nozzle and the reverse gate is the steering nozzle, the valve is moved between the open and closed positions by rotation of the steering nozzle about the VTS axis; and when the at least one of the steering nozzle and the reverse gate is the reverse gate, the valve is moved by movement of the reverse gate such that the valve is moved to the closed position when the reverse gate is moved to a predetermined position, the predetermined position being the fully lowered position or a position intermediate the stowed position and the fully lowered position.

18. The watercraft of claim 17, wherein:

the impeller is rotatable about an impeller rotation axis in (i) a forward direction whereby the impeller propels water from the water inlet rearward and out of the venturi outlet, and (ii) a reverse direction whereby the impeller propels water from the venturi outlet forward and out of the water inlet;

the valve being in the open position when the impeller rotates in the forward direction while the watercraft is in use thereby allowing flow of water through the venturi outlet to move water out of the motor compartment, the water entering the fluid inlet of the fluid conduit and exiting the fluid outlet of the fluid conduit, and the valve being in the closed position when the impeller rotates in the reverse direction while the watercraft is in use.

19. The watercraft of claim 17, wherein at least one of the steering nozzle and the reverse gate includes the steering nozzle and the valve is operatively connected to the steering nozzle.

20. The watercraft of claim 19, wherein:

the steering nozzle is pivotable about the VTS axis between a plurality of trim-up positions and a plurality of trim-down positions;

the valve is moved to the closed position when the steering nozzle is pivoted to a predetermined trim-down position of the plurality of trim-down positions; and the valve is at least partially open at positions other than the predetermined trim-down position.

21. The watercraft of claim 20, further comprising a VTS support pivotable about the VTS axis;

wherein:

the steering nozzle pivots with the VTS support about the VTS axis;

the steering nozzle pivots about the steering axis relative to the VTS support; and the valve is operatively connected to the VTS support.

22. The watercraft of claim 21, further comprising a link operatively connecting the valve to the VTS support, the link being pivotally connected to the valve, and the link being pivotally connected to the VTS support.

* * * * *